US012637928B2

(12) United States Patent
Clyburn et al.

(10) Patent No.: US 12,637,928 B2
(45) Date of Patent: May 26, 2026

(54) MULTI VALVE CONTROL FOR PUMPS

(71) Applicant: Halliburton Energy Services, Inc., Houston, TX (US)

(72) Inventors: Andrew Silas Clyburn, Duncan, OK (US); Justin Lee Hurst, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 300 days.

(21) Appl. No.: 18/515,880

(22) Filed: Nov. 21, 2023

(65) Prior Publication Data

US 2025/0163784 A1 May 22, 2025

(51) Int. Cl.

| | |
|---|---|
| ***E21B 43/12*** | (2006.01) |
| ***F04B 43/08*** | (2006.01) |
| ***F04B 53/10*** | (2006.01) |

(52) U.S. Cl.

CPC ..... *E21B 43/121* (2013.01); *F04B 43/08* (2013.01); *F04B 53/10* (2013.01)

(58) Field of Classification Search

CPC ..... F04B 43/08; F04B 53/10; E21B 43/121; Y10T 137/86163; Y10T 137/2125

USPC ..... 417/472

See application file for complete search history.

(56) References Cited

U.S. PATENT DOCUMENTS

| | | | | |
|---|---|---|---|---|
| 4,080,107 A * | 3/1978 | Ferrentino | ..... | H02G 15/26 417/388 |
| 4,930,401 A * | 6/1990 | Cameron | ..... | F15B 18/00 91/32 |
| 4,948,349 A * | 8/1990 | Koiwa | ..... | F04B 53/108 417/385 |

(Continued)

FOREIGN PATENT DOCUMENTS

| | | | | |
|---|---|---|---|---|
| DE | 20041011444 A1 | 9/2005 | | |
| DE | 102004011444 A1 * | 9/2005 | ..... | B05B 7/14 |
| JP | 2009030442 A * | 2/2009 | | |

OTHER PUBLICATIONS

Filing Receipt, Specification and Drawings for U.S. Appl. No. 63/502,061, filed May 12, 2023, entitled "Systems and Methods Using a Bellows Pump to Perform Operations for a Subterranean Formation," 78 pages.

(Continued)

*Primary Examiner* — Mark A Laurenzi
*Assistant Examiner* — Benjamin Doyle
(74) *Attorney, Agent, or Firm* — Conley Rose, P.C.; Rodney B. Carroll

(57) ABSTRACT

A pump comprising a fluid end comprising a bellows housing having an interior volume, a power end, a reciprocating element, a bellows disposed at least partially within the bellows housing and dividing the interior volume of the bellows housing into a first volume interior to the bellows and a second volume exterior to the bellows, suction valve (s) fluidly coupled to the second volume of the bellows (Continued)

housing. and discharge valve(s) fluidly coupled to the second volume of the bellows housing. The suction valve(s), the discharge valve(s), or both the suction valve(s) and the discharge valve(s) comprise a redundant valve including at least two of said valves, such that, during normal operation, one of the at least two said valves of the redundant valve is open/online while another of the at least two said valves of the redundant valve is closed/offline.

20 Claims, 9 Drawing Sheets

(56) References Cited

U.S. PATENT DOCUMENTS 5,308,230 A * 5/1994 Moore ..... F04B 43/1136 417/394
5,462,086 A * 10/1995 Taylor ..... F16K 17/048 137/865
9,518,577 B2 * 12/2016 van Boeyen ..... F04B 43/1136
10,408,204 B2 * 9/2019 Suzuki ..... F04B 53/10
10,895,254 B2 1/2021 Beisel
11,125,225 B2 * 9/2021 Beisel ..... F04B 9/045
11,268,502 B2 3/2022 Mollatt
11,286,920 B2 3/2022 Mollatt
11,401,792 B2 8/2022 Mollatt
11,441,557 B2 * 9/2022 Beisel ..... F04B 15/02
2003/0053921 A1 * 3/2003 Nishio ..... F04B 53/10 417/472
2008/0145248 A1 * 6/2008 Kato ..... F04B 43/113 417/464
2010/0064702 A1 * 3/2010 Lifson ..... B60H 1/00428 700/282
2016/0298621 A1 * 10/2016 Niethammer ..... F04B 9/045
2018/0313196 A1 * 11/2018 Frantz, III ..... F04B 53/10
2021/0190065 A1 * 6/2021 Ferden ..... F04B 51/00
2022/0126806 A1 * 4/2022 Leiber ..... B60T 13/745
2023/0340859 A1 * 10/2023 Belshan ..... E21B 43/2607

OTHER PUBLICATIONS

First Examiner's Report Canadian Intellectual Property Office International Application No. 3,224,02, dated Jul. 18, 2025, 6 pages.

* cited by examiner

MULTI VALVE CONTROL FOR PUMPS

TECHNICAL FIELD

The present disclosure relates generally to fluid pumping and, more particularly, to systems and methods that utilize multi-valve control for pumps used for fluid pumping.

BACKGROUND

High pressure fluid pumping in utilized extensively in oil and gas operations. To produce hydrocarbons (for example, oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore. A drilling fluid or mud can be utilized during drilling of a wellbore.

Generally, after a wellbore has been drilled to a desired depth, completion operations are performed. Such completion operations may include inserting a liner or casing into the wellbore and, at times, cementing the casing or liner into place. Once the wellbore is completed as desired (lined, cased, open hole, or any other known completion), a stimulation operation may be performed to enhance hydrocarbon production into the wellbore. Examples of some common stimulation operations involve hydraulic fracturing, acidizing, fracture acidizing, and hydro jetting. Stimulation operations are intended to increase the flow of hydrocarbons from the subterranean formation surrounding the wellbore into the wellbore itself so that the hydrocarbons may then be produced up to the wellhead.

One typical formation stimulation process may involve hydraulic fracturing of the formation and placement of a proppant in those fractures. Typically, a stimulation fluid (comprising at least a clean fluid and a proppant) is mixed at the surface before being pumped downhole in order to induce fractures or perforations in the formation of interest. The creation of such fractures or perforations will increase the production of hydrocarbons by increasing the flow paths into the wellbore.

A variety of pressure pumps are utilized in wellbore drilling and treatments. For example, hydraulic fracturing (also known as "fracking" or "hydro-fracking") may utilize a pressure pump to introduce or inject fluid at high pressures into a wellbore to create cracks or fractures in downhole rock formations. Due to the high-pressured and high-stressed nature of the pumping environment, pressure pump parts may undergo mechanical wear and require frequent replacement. The frequent change of parts may result in additional costs for the replacement parts and additional time due to the delays in operation while the replacement parts are installed. In some cases, reciprocating, intensifier-type, or linear actuated pumps are deployed in order to pump the fluid (e.g., drilling fluid, stimulation fluid) downhole.

BRIEF SUMMARY OF THE DRAWINGS

For a more complete understanding of this disclosure, reference is now made to the following brief description, taken in connection with the accompanying drawings and detailed description, wherein like reference numerals represent like parts.

Figure 1A:
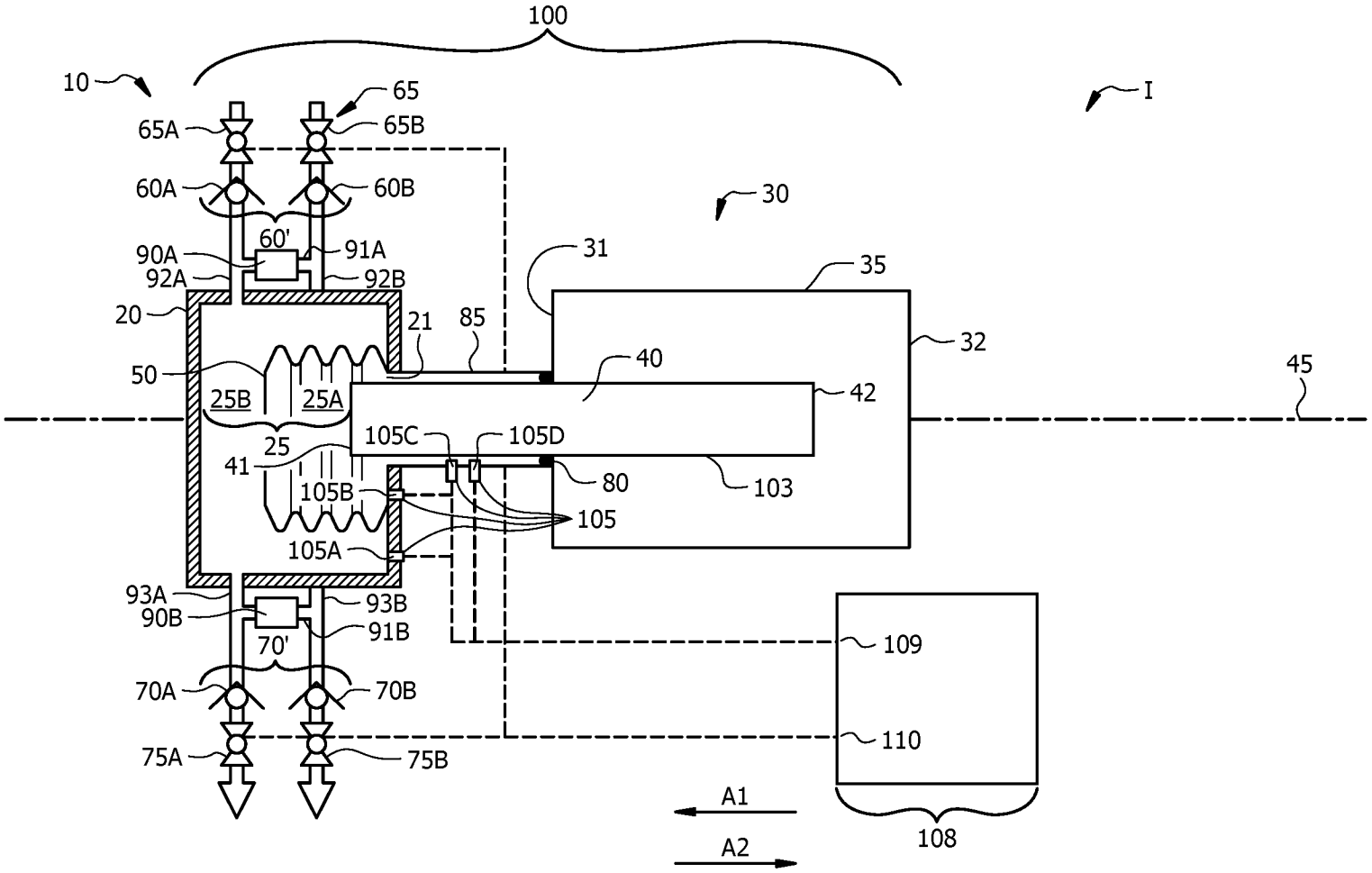
FIG. 1A is a two-dimensional cross-sectional diagram illustrating an example of a pump system, according to one or more aspects of the present disclosure.

While embodiments of this disclosure are depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "la" refers to an instance of a widget class, which may be referred to collectively as widgets "1" and any one of which may be referred to generically as a widget "1". For example, reference to suction valve or valves 60 can include the one or more suction valves 60/360 of a redundant suction valve 60'/360' (also referred to herein as a redundant suction valve pair 60'/360' with reference to FIGS. 1A-1E and FIG. 3 or, more generically, as a redundant suction valve set 60'/360'); similarly, reference to discharge valve or valves 70/370 can include the one or more discharge valves 70/370 of a redundant discharge valve 70'/370' (also referred to herein as a redundant discharge valve pair 70'/370' with reference to FIGS. 1A-1E and FIG. 3 or, more generically, as a redundant discharge valve set 70'/370'). In the figures and the description, like numerals can be intended to represent like elements, where possible. Reference to #1/#2 indicates "and/or". For example, redundant valve 60'/70' indicates redundant valve 60', redundant valve 70', or both redundant valves 60' and 70'.

To facilitate a better understanding of the present disclosure, the following examples of certain embodiments are given. In no way should the following examples be read to limit, or define, the scope of the disclosure. Embodiments described below with respect to one implementation are not intended to be limiting.

The terms "couple" or "couples," as used herein, are intended to mean either an indirect or direct connection. Thus, if a first device couples to a second device, that connection may be through a direct connection, or through an indirect electrical connection or a shaft coupling via other devices and connections.

The present disclosure provides systems and methods for pumping fluids downhole. The exemplary description that follows will discuss using treatment fluids to carry out subterranean treatments in conjunction with a variety of subterranean operations, including, but not limited to, hydraulic fracturing operations, fracturing acidizing operations to be followed with proppant hydraulic fracturing operations, stimulation treatments, and the like. It is to be understood that any number of other fluids can be pumped downhole or elsewhere via the disclosed systems and method during a variety of applications, and such are intended to be within the scope of this disclosure.

In one or more embodiments, a treatment fluid may be introduced into a wellbore that penetrates a subterranean formation at a pressure sufficient to create or enhance one or more fractures within the subterranean formation (for example, hydraulic fracturing) and/or to create or enhance and treat microfractures within a subterranean formation in fluid communication with a primary fracture in the formation. In one or more embodiments, the systems and methods of the present disclosure may be used to treat pre-existing fractures, or fractures created using a different treatment fluid. In one or more embodiments, a treatment fluid may be introduced at a pressure sufficient to create or enhance one or more fractures within the formation, and one or more of the treatment fluids comprising a proppant material subsequently may be introduced into the formation.

The systems and methods described herein may be used in controlling a treatment operation for a subterranean formation. For example, the treatment may be modified by monitoring suction and/or discharge valves of a pump with a control system (also referred to herein as a "valve monitoring system"). The valve monitoring system may receive data measurements from one or more sensors associated with operation of the bellows pump and may prevent failure via an output and/or provide a maintenance recommendation for a related component of the bellows pump.

In one or more embodiments of the present disclosure, an environment may utilize an information handling system to control, manage or otherwise operate one or more operations, devices, components, networks, any other type of system or any combination thereof. For purposes of this disclosure, an information handling system may include any instrumentality or aggregate of instrumentalities that are configured to or are operable to compute, classify, process, transmit, receive, retrieve, originate, switch, store, display, manifest, detect, record, reproduce, handle, or utilize any form of information, intelligence, or data for any purpose, for example, for a maritime vessel or operation. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device. For the purposes of this disclosure, computer-readable media may include any instrumentality or aggregation of instrumentalities that may retain data, instructions or both for a period of time. Computer-readable media may include, for example, without 5 limitation, storage media such as a sequential access storage device (for example, a tape drive), direct access storage device (for example, a hard disk drive or floppy disk drive), compact disk (CD), CD read-only memory (ROM) or CD-ROM, DVD, RAM, ROM, electrically erasable programmable read-only memory (EEPROM), and/or flash memory, biological memory, molecular or deoxyribonucleic acid (DNA) memory as well as communications media such wires, optical fibers, microwaves, radio waves, and other electromagnetic and/or optical carriers; and/or any combination of the foregoing.

In one or more embodiments, one or more pumps associated with a treatment system according to the present disclosure may be powered using natural gas produced from the same area in which fracturing operations are to be performed or are concurrently being performed. For example, one or more pumps may be powered by a natural gas fired engine or a natural gas fired generator set that produces electricity to power the one or more pumps. In this example, the natural gas used to power the one or more pumps and/or other system components may be obtained from the field on which the subterranean operations are being performed. The natural gas may be converted to liquefied natural gas and used to power the pumps and other equipment that would typically be powered by diesel fuel. The natural gas from the field may undergo conditioning before being used to provide power to the pumps and other equipment. The conditioning process may include cleaning the natural gas, compressing the natural gas in compressor stations and if necessary, removing any water contained therein. The present disclosure may include natural gas fired engines and use of natural gas from the same field where the fracturing is being performed.

Description of a pump, pumping system, and methods of using same will now be made with reference to FIGS.

Figure 1B:
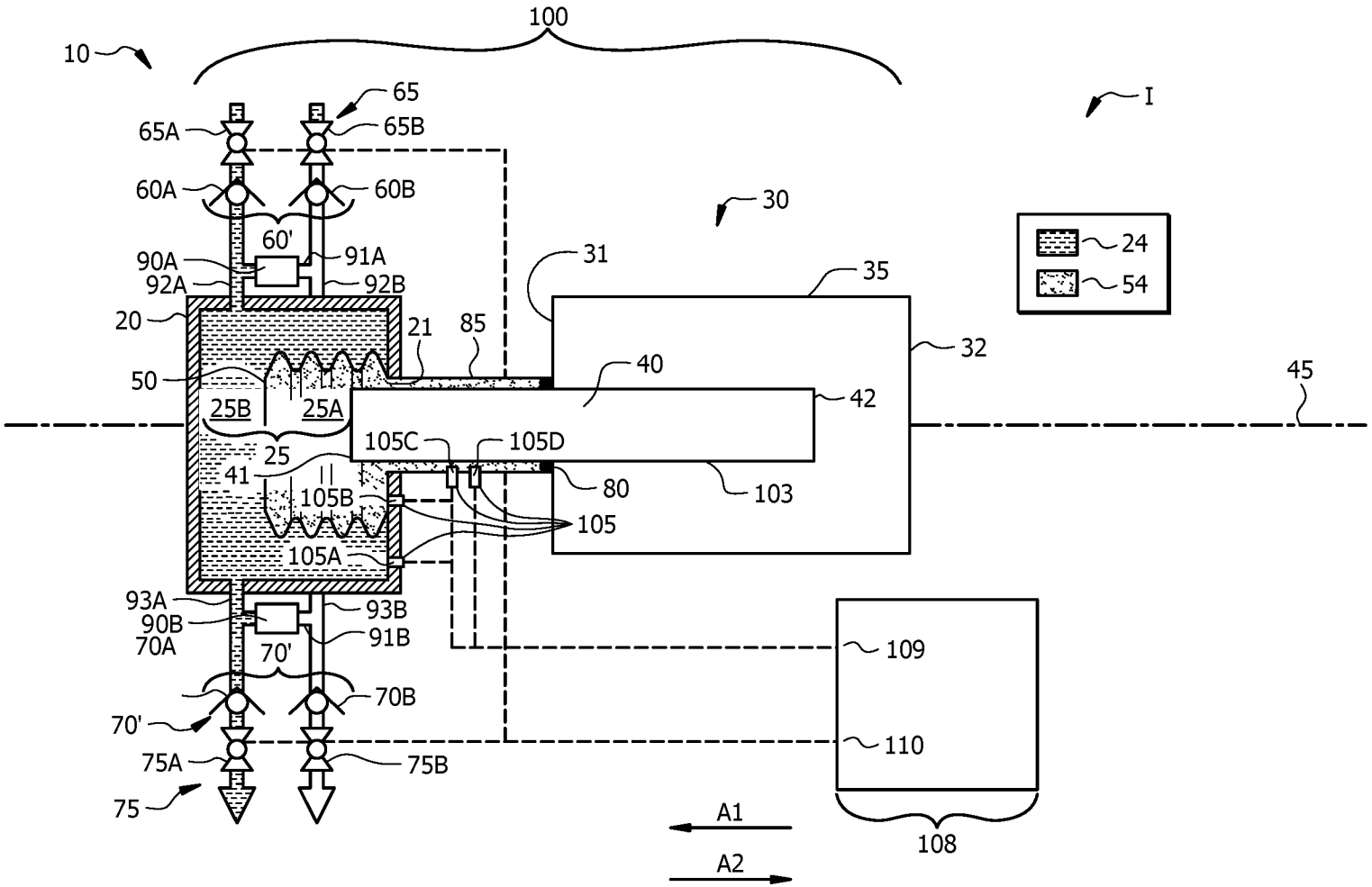
FIG. 1B shows the pump system of FIG. 1A operating with a first discharge valve of a redundant discharge valve pair.
Figure 1C:
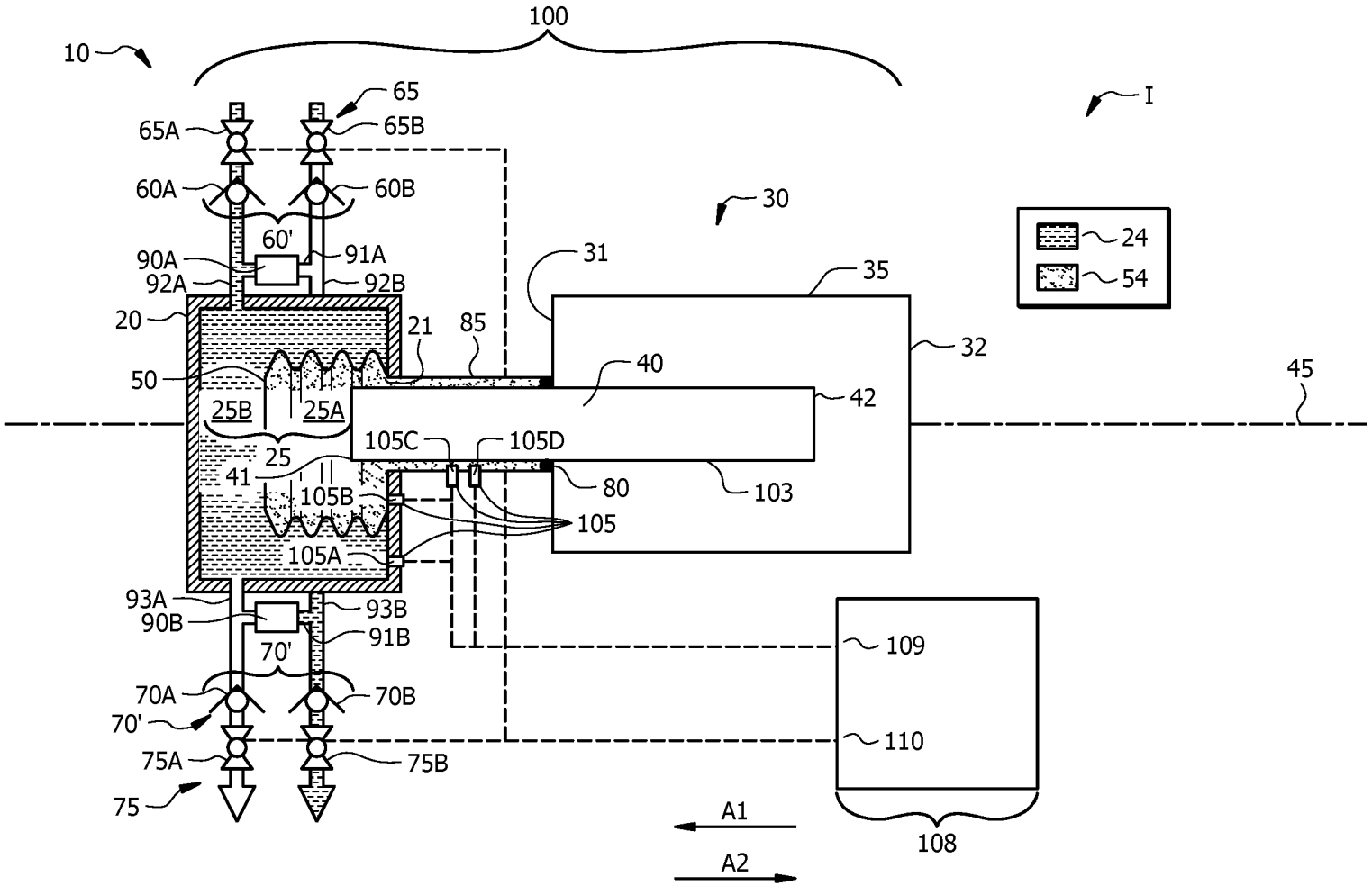
FIG. 1C shows the pump system of FIG. 1A operating with a second discharge valve of the redundant discharge valve pair.

1A-1F, which are two-dimensional cross-sectional diagrams illustrating example pump systems according to one or more aspects of the present disclosure. With reference to FIGS. 1A-1C, which are a two-dimensional cross-sectional diagrams illustrating an example of a pump system I, according to one or more aspects of the present disclosure, FIG. 1D, which is a two-dimensional cross-sectional diagram illustrating an example of a pump system II, according to one or more aspects of the present disclosure, and FIG. 1E, which is a two-dimensional cross-sectional diagram illustrating an example of a pump system III, according to one or more aspects of the present disclosure, a pump 100 of this disclosure can comprise: a fluid end 10 comprising a bellows housing 20 having (e.g., defining) an interior volume 25 therein; a power end 30 comprising a pump body 35; a reciprocating element 40 having a first end 41 and a second end 42 along a central axis 45 thereof, a bellows 50 disposed at least partially within the bellows housing 20 and dividing the interior volume 25 of the bellows housing 20 into a first volume 25A (also referred to as a first interior volume 25A) interior to the bellows 50 and a second volume 25B (also referred to as a second interior volume 25B) exterior to the bellows 50, one or more suction valves 60, with two, including a first suction valve 60A and a second suction valve 60B shown in the embodiment of FIGS. 1A-1E, and one or more discharge valves 70, with two discharge valves, including a first discharge valve 70A and a second discharge valve 70B shown in the embodiment of FIGS. 1A-1E. Each of the one or more suction valves 60 (e.g., first suction valve 60A and second suction valve 60B in the embodiment of FIGS. 1A-1E) can be fluidly coupled to the second volume 25B of the interior volume 25 of the bellows housing 20, and each of the one or more discharge valves 70 (e.g., first discharge valve 70A and second discharge valve 70B in the embodiment of FIGS. 1A-1E) can be fluidly coupled to the second volume 25B of the interior volume 25 of the bellows housing 20.

The reciprocating element 40 moves away from (in the direction of arrow A1 in FIG. 1A) and toward (in the direction of arrow A2 in FIGS. 1A-1E) the back 32 of the power end 30, through an inlet 21 of the bellows housing 20, during operation of the pump 100, and the bellows 50 expands and contracts with the reciprocation of the reciprocating element 40 respectfully away from and toward the back 32 of the power end 30 during operation of the pump 100. The one or more suction valves 60, the one or more discharge valves 70, or both the one or more suction valves 60 and the one or more discharge valves 70 can comprise a redundant valve 60'/70', wherein the redundant valve 60'/70' comprises at least two of said valves. During normal operation of pump 100, one of the at least two said valves of the redundant valve 60'/70' can be open/online while another one or more of the at least two said valves of the redundant valve 60'/70' can be closed/offline. In the embodiment of FIGS. 1A-1E, the redundant valve 60'/70' includes a redundant suction valve 60' comprising first suction valve 60A and second suction valve 60B, and a redundant discharge valve 70' comprising first discharge valve 70A and second discharge valve 70B. In alternative embodiments, a pump 100 of this disclosure comprises a redundant suction valve 60' including at least two suction valves 60 (e.g., a first suction valve 60A and a second suction valve 60B) and a single discharge valve (e.g., first discharge valve 70A or second discharge valve 70B only). In alternative embodiments, a pump 100 of this disclosure comprises a redundant discharge valve 70' including at least two discharge valves 70 (e.g., a first discharge valve 70A and a second discharge valve 70B) and a single suction valve (e.g., first suction valve 60A or second suction valve 60B only).

The redundant valve 60' and/or 70' can comprise any number of said valve greater than two, for example, 2, 3, 4 or more of said suction or discharge valves. In embodiments such as depicted in FIGS. 1A-1F, the redundant valve(s) 60'/70' comprise two of said valves. For example, as depicted in the embodiment of FIGS. 1A-1F, and noted hereinabove, the redundant valve 60'/70' can comprise a redundant suction valve 60' including a first suction valve 60A and a second suction valve 60B, a redundant discharge valve 70' comprising a first discharge valve 70A and a second discharge valve 70B, or both a redundant suction valve 60' and a redundant discharge valve 70'. The suction valve(s) 60 and the discharge valve(s) 70 can be independently positioned external to the bellows housing 20, as depicted in FIGS. 1A-1F, or internal to the bellows housing 20. For example, as depicted in FIGS. 1A-1F, the first suction valve 60A, the second suction valve 60B, the first discharge valve 70A, the second discharge valve 70B, or a combination thereof can be positioned external to the bellows housing 20. Alternatively or in combination, the first suction valve 60A, the second suction valve 60B, the first discharge valve 70A, the second discharge valve 70B, or a combination thereof can be independently positioned internal to the bellows housing 20.

The first or front end 41 of the reciprocating element 40 is distal a second or back end 42 thereof. The front end 41 of the reciprocating element 40 is distal (e.g., is farther from) a back 32 of the power end 30 along the central axis 45 of the reciprocating element 40 relative to the second or back end 42 of the reciprocating element 40, which back end 42 is proximal (e.g., closer to) the back 32 of the power end 30 along the central axis 45 relative to the front end 41 of the reciprocating element 40.

The pump 100 can be any pump employing a reciprocating element 40, such as, and without limitation, a reciprocating pump, an intensifier pump, a linear actuated pump, or a combination thereof. The reciprocating element 40 can comprise a plunger (e.g., of a reciprocating pump) or an intensifier (e.g., of an intensifier pump). Although a single bellows 50 is depicted in the embodiment of FIGS. 1A-1F, multiple bellows 50 can be associated with the reciprocating element 40. In embodiments, the pump 100 can be a single action intensifier pump or a dual action intensifier pump.

When reciprocating element (e.g., piston) 40 is fully extended toward fluid end 10, bellows 50 is displacing the maximum amount of a first fluid 24 (e.g., a treatment fluid being pumped) from the interior 25 of fluid end 10, and when reciprocating element 40 is fully retracted from the fluid end 10, bellows 50 is displacing the least amount of the fluid 24 inside the fluid end 10. The hydraulic reciprocation of reciprocating element 40 causes corresponding reciprocation of bellows 50 inside the fluid end 10. During the retraction of reciprocating element 40 (e.g., along direction A2 in FIGS. 1A-1E), treatment fluid 24 is drawn into the fluid end 10 through a suction valve 60 and this may be referred to as a suction stroke. During the extension of reciprocating element 40 toward the fluid end 10 (e.g., along the direction A1 in FIGS. 1A-1E), treatment fluid 24 being pumped is pushed out of the fluid end 10 through a discharge valve 70 and this may be referred to as a discharge stroke.

In some embodiments, multiple systems can be joined together to form a larger multi-cylinder pumping system. For example, in some embodiments, the pump body 35 may be formed to include multiple-cylinder systems that may be formed of a single mono-block of material. That is, in some embodiments, the pump body 35 may have multiple reciprocating elements 40 disposed within respective cylinders of the pump body 35 that have corresponding fluid ends 10 directly connected to the respective opening or channel driven by the respective reciprocating element 40.

The pump 100 (or pump 300 of FIG. 3 described hereinbelow) can further comprise a suction control valve 65 associated with each of the one or more suction valves 60, a discharge control valve 75 associated with each of the one or more discharge valves 70, or a combination thereof. One or more of the suction valves 60 can be positioned between the suction control valve 65 associated therewith and the bellows housing 20, and one or more discharge valves 70 can be positioned between the discharge control valve 75 associated therewith and the bellows housing 20. In embodiments, each of the one or more suction valves 60 can be positioned between the suction control valve 65 associated therewith and the bellows housing 20, and/or each of the one or more discharge valves 70 can be positioned between the discharge control valve 75 associated therewith and the bellows housing 20. For example, in the embodiment of FIG. 1A, first suction valve 60A is positioned on a first suction flow line 92A between first suction control valve 65A and bellows housing 20, second suction valve 60 is positioned on a second suction flow line 92B between second suction control valve 65A and bellows housing 20, first discharge valve 70A is positioned on a first discharge flow line 93A between first discharge control valve 75A and bellows housing 20, and second discharge valve 70B is positioned on a second discharge flow line 93B between second discharge control valve 75B and bellows housing 20.

Alternatively or in combination, one or more suction control valves 65 can be positioned between the suction valve 60 with which it is associated and the bellows housing 20 and/or one or more discharge control valves 75 can be positioned between the discharge valve 70 with which it is associated and the bellows housing 20. In embodiments, each of the suction control valves 65 is positioned between the suction valve 60 with which it is associated and the bellows housing 20 and wherein each of the one or more discharge control valves 75 can be positioned between the discharge valve 70 with which it is associated and the bellows housing 20. For example, in the embodiment of FIG. 1D, first discharge control valve 75A is positioned on line 93A between first discharge valve 70A and bellows housing 20, and second discharge control valve 75B is positioned on line 93B between second discharge valve 70B and bellows housing 20. Alternatively or in combination, one or more suction control valves 65 can be positioned between the suction valve 60 with which it is associated, for example, in embodiments, first suction control valve 65A can be positioned on first suction flow line 92A between first suction valve 60A and bellows housing 20, and second suction control valve 65B can be positioned on second suction flow line 92B between second suction valve 60B and bellows housing 20.

Figure 1D:
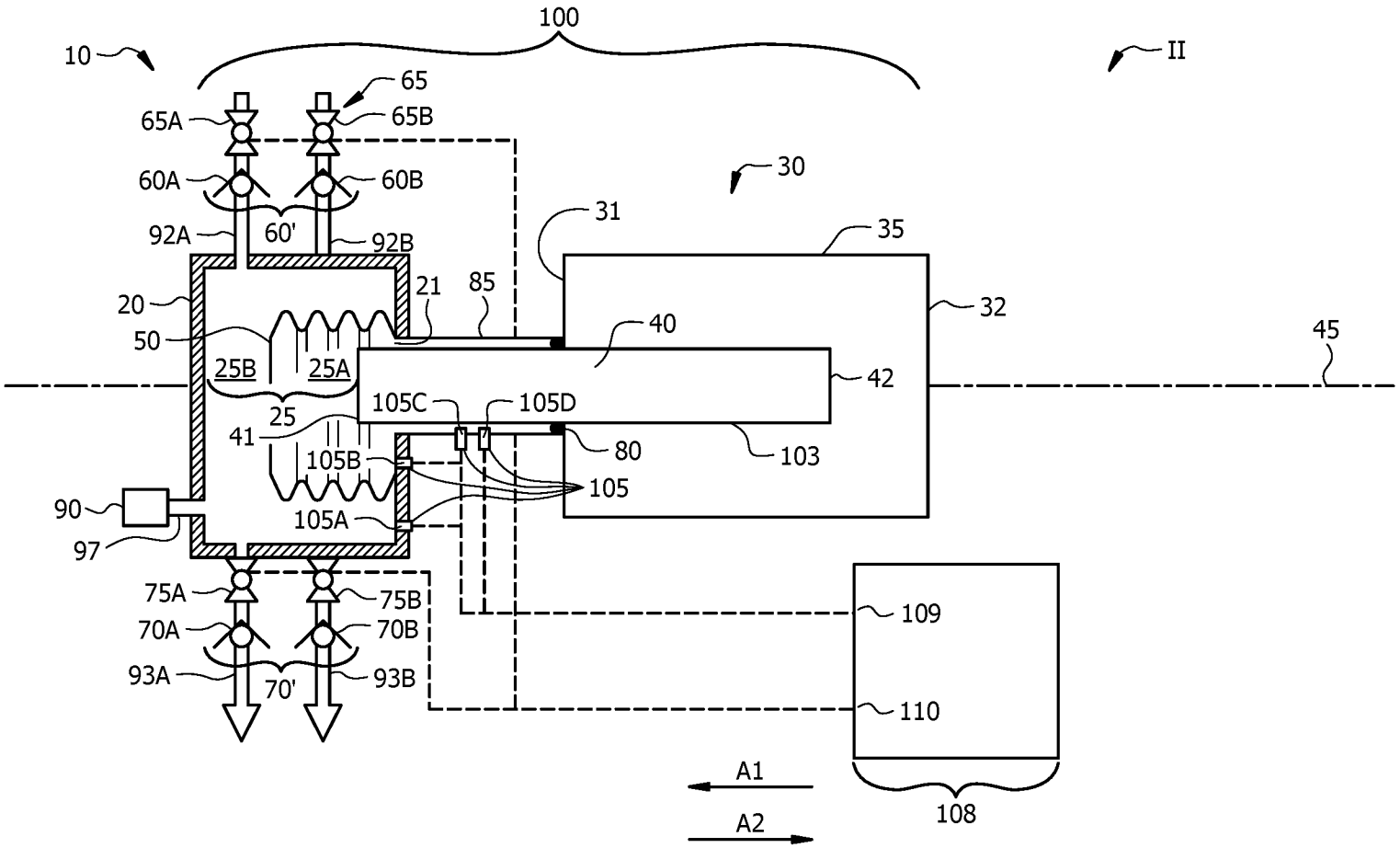
FIG. 1D is a two-dimensional cross-sectional diagram illustrating an example of another pump system, according to one or more aspects of the present disclosure.
Figure 1E:
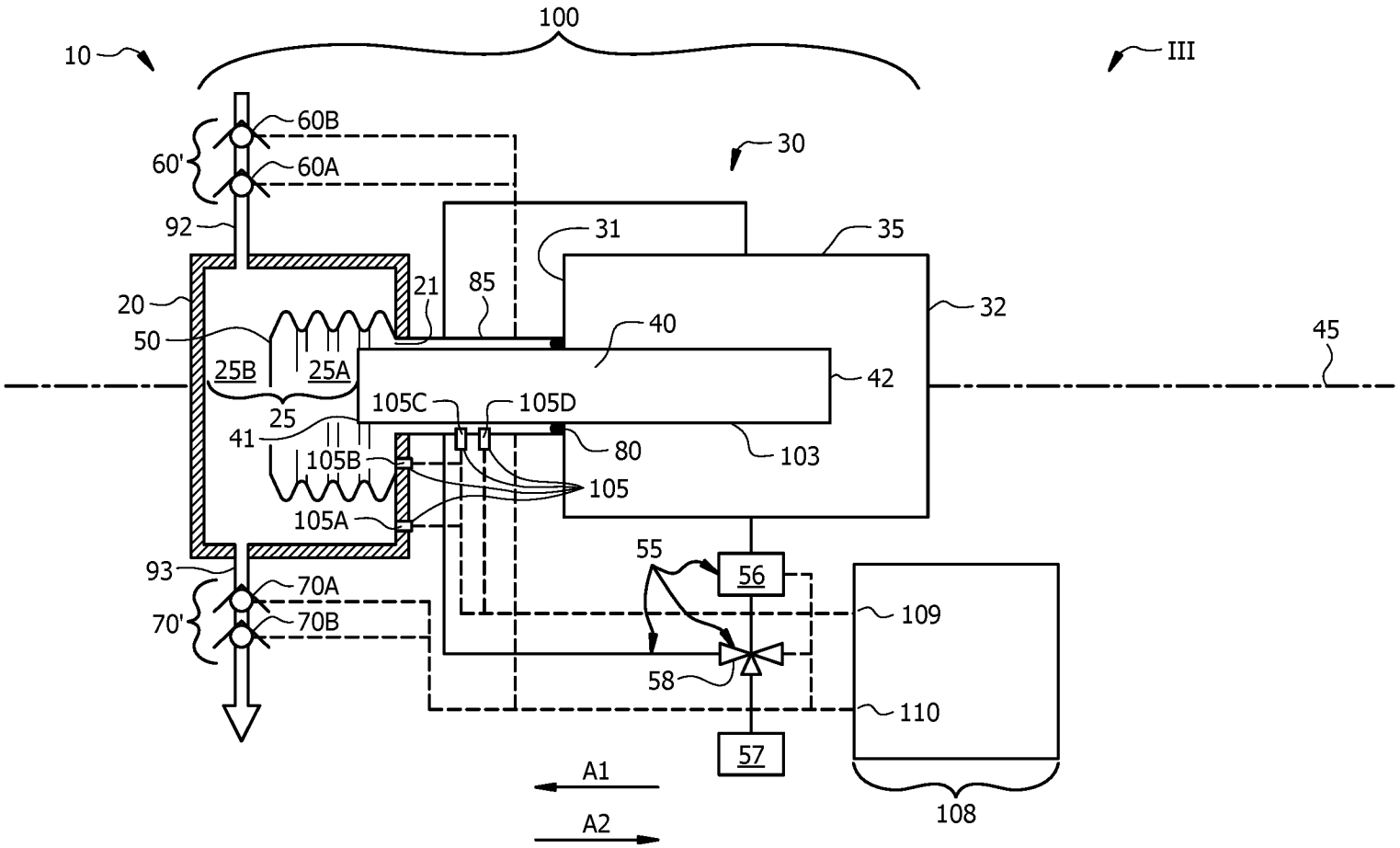
FIG. 1E is a two-dimensional cross-sectional diagram illustrating an example of another pump system, according to one or more aspects of the present disclosure.

In embodiments, the one or more suction valves 60 can comprise at least two electrically actuated suction valves 60, the one or more discharge valves 70 can comprise at least two electrically actuated discharge valves 70, or the one or more suction valves 60 can comprise at least two electrically actuated suction valves 60 and the one or more discharge valves 70 can comprise at least two electrically actuated discharge valves 70. For example, as depicted in in the embodiment of FIG. 1E, pump 100 of FIG. 1E comprises a redundant suction valve 60' comprising first electrically actuated suction valve 60A and second electrically actuated suction valve 60B, and a redundant discharge valve 70' comprising first electrically actuated discharge valve 70A and second electrically actuated discharge valve 70B. The at least two electrically actuated suction valves 60, the at least two electrically actuated discharge valves 70, or the at least two electrically actuated suction valves 60 and the at least two electrically actuated discharge valves 70 can be in series. Alternatively or in combination, the at least two electrically actuated suction valves 60, the at least two electrically actuated discharge valves 70, or the at least two electrically actuated suction valves 60 and the at least two electrically actuated discharge valves 70 can be in parallel. In the embodiment of FIG. 1E, the first electrically actuated suction valve 60A and the second electrically actuated suction valve 60B are in series on suction flow line 92, and the first electrically actuated discharge valve 70A and the second electrically actuated discharge valve 70B are in series on discharge flow line 93. Alternatively, first electrically actuated suction valve 60A can be on a first suction flow line 92A (first suction flow line 92A shown in FIGS. 1A-1D) and second electrically actuated suction valve 60B can be on a second suction flow line 92B (second suction flow line 92B shown in FIGS. 1A-1D) and/or first electrically actuated discharge valve 70A can be on a first discharge flow line 93A (first discharge flow line 93A shown in FIGS. 1A-1D) and second electrically actuated discharge valve 70B can be on a second discharge flow line 93B (second discharge flow line 93B shown in FIGS. 1A-1D).

Pump 100 can further include a reciprocating element seal 80 between the reciprocating element 40 and a front wall 31 of the pump body 30, and within a reciprocating element bore 85 extending from the front wall 31 of the pump body 30 to the inlet 21 of the bellows housing 20. The reciprocating element 40 reciprocates within/through the reciprocating element bore 85 during pumping. The reciprocating element bore 85 comprises makeup fluid 54 (also referred to herein as driving fluid, drive fluid, or hydraulic fluid 54).

The pump 100 can be a high pressure pump that can operate during pumping of a wellbore servicing fluid (or "treatment fluid") at a pressure of greater than or equal to about 1,000 psi, 3,000 psi, 5,000 psi, 10,000 psi, 20,000 psi, 30,000 psi, 40,000 psi, or 50,000 psi, or a range thereamong (e.g., from about 1000 psi to about 50,000 psi). The pump 100 can be a high pressure pump 100 that operates, during the pumping of a wellbore servicing fluid comprising solid particulates, at a volumetric flow rate of greater than or equal to about 1, 3, 10, or 20 barrels per minute (BPM), or in a range of from greater than 0 to about 20 BPM, about 3 to about 20 BPM, from about 10 to about 20 BPM, or from about 5 to about 20 BPM. As discussed further hereinbelow, solid particulates can comprise sand, proppant, drill cuttings, or a combination thereof.

The pump 100 can have a stroke of from about 1 to about 10 feet (e.g., greater than or equal to about 5 feet) and a reciprocation rate of from about 1 to 100 strokes per minute, wherein the stroke is a difference between a fully extended position and a fully retracted position of the reciprocating element.

The (e.g., each of the) one or more suction valves 60, the (e.g., each of the) one or more discharge valves 70, or a combination thereof can comprise a check valve. In embodiments, the pump 100 is a hydraulic intensifier unit designed and/or is controlled as disclosed in U.S. Pat. Nos. 11,286,920; 11,268,502; 11,401,792, the disclosure of each of which is hereby incorporated herein for purposes not contrary to this disclosure, adapted to comprise a redundant valve(s) 60'/70' (e.g., a redundant suction valve 60' comprising at least two suction valves 60, a redundant discharge valve 70' comprising at least two discharge valves 70, or both a redundant suction valve 60' comprising at least two suction valves 60 and a redundant discharge valve 70 comprising at least two discharge valves 70) and control system 108 adapted for controlling which valves are online as described herein.

Pump 100 can further comprise at least one pressure relief valve 90. The at least one pressure relief valve 90 can comprise: a pressure relief valve 90 on a line fluidly connecting a line on which the one of the at least two said valves of the redundant valve 60'/70' is located and a line on which the another of the at least two said valves of the redundant valve 60'/70' is located; a pressure relief valve 90 on a line extending from or otherwise fluidly coupled with the bellows housing 20; or a combination thereof. For example, with reference to the embodiments of FIGS. 1A-1C comprising redundant suction valve 60' comprising first suction valve 60A on first suction flow line 92A and second suction valve 60B on second suction flow line 92B, and redundant discharge valve 70' comprising first discharge valve 70A on first discharge flow line 93A and second discharge valve 70B on second discharge flow line 93B, the at least one pressure relief valve 90 can comprise a (e.g., first) pressure relief valve 90A on a line 91A fluidly connecting first suction flow line 92A on which first suction valve 60A of the at least two suction valves 60 of the redundant suction valve 60' is located and second suction flow line 92B on which the other or second suction valve 60B of the at least two suction valves 60 of the redundant suction valve 60' is located; and/or a pressure relief valve 90B on line 91B fluidly connecting first discharge flow line 93A on which one (e.g., first) discharge valve 70A of the at least two discharge valves 70 of the redundant discharge valve 70' is located and second discharge flow line 93B on which the another (e.g., second) discharge valve 70B of the at least two discharge valves 70 of the redundant discharge valve 70' is located. As depicted in FIG. 1D, a pressure relief valve 90 can be positioned on (e.g., a line 97 extending from) the bellows 50 housing 20.

As depicted in FIGS. 1A-1E, a pump system of this disclosure can comprise pump 100 as described herein and a control system 108; and one or more sensors 105 associated with the pump 100. The control system 108 can comprise one or more processors 202 (described hereinbelow with reference to FIG. 2) and a non-transitory computer readable media 206 (described hereinbelow with reference to FIG. 2) coupled to the one or more processors 202 having instructions stored thereon that, when executed by the one or more processors 202, causes the control system to: monitor (e.g., receive input 109 from) the one or more sensors 105 associated with the pump 100; and control, based on the input 109 and via one or more outputs 110, operation of the one or more suction valves 60, the one or more discharge valves 70, or a combination thereof.

The control system 108 can control the operation of the one or more suction valves 60, the one or more discharge valves 70, or the combination thereof by opening another/offline of the said valves of the redundant valve 60'/70' and subsequently closing the one/online of the said valves of the redundant valve 60'/70', for example upon determination that the one or online of the said valves is failing or has failed.

For example, as depicted by fluid shading in FIG. 1B, pump 100 can be pumping a wellbore servicing or "treatment" fluid 24 from a slurry source (e.g., fracturing fluid producing apparatus 620 of FIG. 6, described further hereinbelow) into a well 660 (FIG. 6) with first suction valve 60A and first discharge valve 70A in operation and second suction valve 60B of redundant suction valve 60' offline and second discharge valve 70B of redundant discharge valve 70' offline. In normal operation, the pump 100 can operate on one side of suction valves 60 and discharge valves 70 (e.g., first suction valve 60 and first discharge valve 70A in this example). The control system 108 can monitor sensors 105 during pumping to detect when a suction valve 60 or discharge valve 70 is bad. When first suction valve 60A or first discharge valve 70A is identified as being bad the control system 108 can effect opening of the control valve associated with another/offline valve of the redundant valve, thus allowing treatment fluid 24 to start flowing on the other valve. For example, when first suction valve 60A is identified as being bad the control system 108 can effect opening of the second suction control valve 65B for the other valve (e.g., second suction valve 60B) of the redundant suction valve 60', thus allowing treatment fluid 24 to start flowing on the other or second suction valve 60B. Once the second suction control valve 65B is reported to be open, then the control system can effect closing of the first suction control valve 60A. At this point the control system 108 can verify or confirm that the conditions are corrected without disrupting operations. By way of further example, should first discharge valve 70A be the valve identified as being bad, the control system 108 can effect opening of the second discharge control valve 65B for the other valve (e.g., second discharge valve 70B) of the redundant discharge valve 70', thus allowing treatment fluid 24 to start flowing on the other or second discharge valve 70B. Once the second discharge control valve 75B is reported to be open, then the control system 108 can output instructions to close the first discharge control valve 70A. At this point the control system 108 can verify the conditions are corrected without disrupting operations.

FIG. 1C depicts the system I of FIG. 1A/1B when first discharge valve 70A is bad, and the control system has sent an output 110 to first discharge control valve 75A and second discharge control valve 75B to operate second discharge valve 70B and place the bad first discharge valve 70A offline. The failure of a valve can be detected by several methods, which will be apparent to those of skill in the art and with the help of this disclosure. For example, as detailed further hereinbelow, one method of detecting a bad valve can comprise detecting pressure in the fluid end 10 when the pump 100 is on a suction stroke. With a bad discharge valve 70, there can be treatment pressure in the fluid end 10 during the suction stroke which can damage the pump 100. Once the bad/failing valve is detected, the control system 108 can initiate switching of pumping over to a good valve (e.g., second discharge valve 70B in the example of FIG. 1C) of the redundant valve (e.g., redundant discharge valve 70' in the example of FIG. 1C).

Treatment fluid 24 can flow through either suction valve 60A/60B or discharge valve 70A/70B, and thus the control system 108 need not control operation on only the first valves 60A/70A or the second valves 60B/70B. The control system 108 can also control opening and closing of the various valves for trouble shooting purposes to identify bad or failing valve(s). By being able to switch between multiple valves of the redundant suction or discharge valve(s) 60'/70', down time can be minimized for an expensive pump.

A variety of sensors can provide input 109 to control system 108 for determination of valve and/or bellow failure and determination of an output (e.g., switch valves of a redundant valve set, shut down the pump, etc.) The one or more sensors 105 can comprise: a sensor 105 (e.g., 105A) configured to determine a pressure of a first fluid (e.g., a wellbore treatment fluid 24) in the second volume 25B of the interior volume 25 of the bellows housing 20; a sensor 105 (e.g., 105B) configured to determine a pressure of a second fluid (e.g., a makeup/driving/hydraulic fluid 54) in the first volume 25A of the interior volume 25 of the bellows housing 20; a sensor 105 (e.g., 105C) configured to determine a flow rate of the first fluid, the second fluid, or both; a sensor 105 (e.g., 105D) configured to determine a position of the bellows 50 (e.g., a distance the bellows 50 extends into the bellows housing 20 from the inlet 21 thereof); a sensor 105 configured to determine a temperature of the first fluid 24, a sensor 105 configured to determine a temperature of the second fluid 54; a viscosity of the first fluid 24; a viscosity of the second fluid 54; or a combination thereof. The inputs 109 to control system 108 can thus include sensor measurements/parameters including, but not limited to, pressure of treatment fluid 24, pressure of hydraulic/driving fluid 54 within bellows 50/350, flow rate of treatment fluid 24, bellows 50/350 position, or a combination thereof. Control system 108 can output control signals for the suction control valves 65 and/or discharge control valves 75 to switch operation from a bad online suction valve 60/360 or discharge valve 70/370 to a good offline suction valve 60/360 or discharge valve 70/370, respectively, of a redundant valve 60'/70' set.

As shown in FIG. 1E, a hydraulic fluid system comprising hydraulic fluid 54 can be utilized to drive reciprocating element 40, in embodiments. Hydraulic fluid system 55 can include a make-up fluid pump 56, a make-up fluid reservoir 57, and a make-up valve 58.

Figure 2:
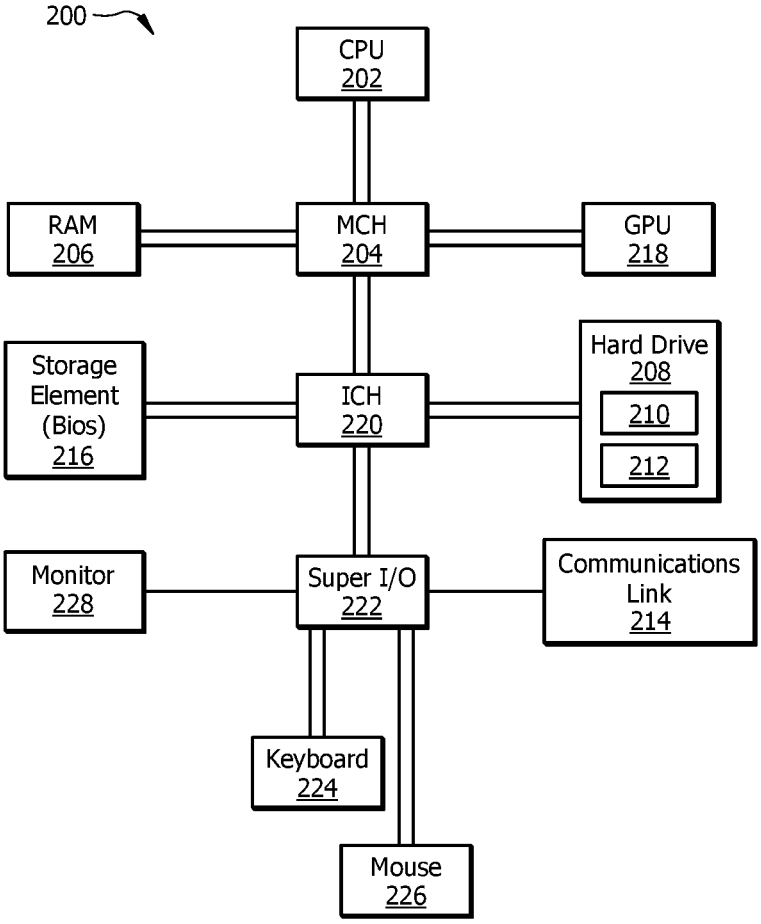
FIG. 2 is a schematic diagram of an information handling system for a well system, according to one or more aspects of the present disclosure.

FIG. 2 is a diagram illustrating an example information handling system 200, for example, for use as, with or by an associated fracturing system of FIG. 6, described hereinbelow, or control system 108 of FIGS. 1A-1E, according to one or more aspects of the present disclosure. For example, the information handling system 200 may be used and function as the control system 108 of FIGS. 1A-1F. A processor or central processing unit (CPU) 202 of the information handling system 200 is communicatively coupled to a memory controller hub (MCH) or north bridge 204. The processor 202 may include, for example a microprocessor, microcontroller, digital signal processor (DSP), application specific integrated circuit (ASIC), or any other digital or analog circuitry configured to interpret and/or execute program instructions and/or process data. Processor 202 may be configured to interpret and/or execute program instructions or other data retrieved and stored in any memory such as memory 206 or hard drive 208. Program instructions or other data may constitute portions of a software or application, for example application 210 or data 212, for carrying out one or more methods described herein. Memory 206 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 210 or data 212 may be retrieved and stored in memory 206 for execution or use by processor 202. In one or more embodiments, the memory 206 or the hard drive 208 may include or comprise one or more non-transitory executable instructions that, when executed by the processor 202, cause the processor 202 to perform or initiate one or more operations or steps. The information handling system 200 may be preprogrammed or it may be programmed (and reprogrammed) by loading a program from another source (for example, from a CD-ROM, from another computer device through a data network, or in another manner).

The data 212 may include treatment data, geological data, fracture data, micro-seismic data, or any other appropriate data. The data 212 may include sensor measurements (e.g., pressure, position, temperature, flow rate, strain measurement, etc.) associated with operation of the bellows pump 100/300 (pump 300 described hereinbelow with reference to FIG. 3). In one or more embodiments, the data 212 may include treatment data relating to fracture treatment plans. For example, the treatment data may indicate a pumping schedule, parameters of a previous injection treatment, parameters of a future injection treatment, or one or more parameters of a proposed injection treatment. Such one or more treatment parameters may include information on flow rates, flow volumes, slurry concentrations, fluid compositions, injection locations, injection times, or other parameters. The treatment data may include one or more treatment parameters that have been optimized or selected based on numerical simulations of complex fracture propagation. In one or more embodiments, the data 212 may include geological data relating to one or more geological properties of the subterranean formation 702 (referring to FIG. 7). For example, the geological data may include information on the wellbore 704 (referring to FIG. 7), completions, or information on other attributes of the subterranean formation 102. In one or more embodiments, the geological data includes information on the lithology, fluid content, stress profile (e.g., stress anisotropy, maximum and minimum horizontal stresses), pressure profile, spatial extent, or other attributes of one or more rock formations in the subterranean zone. The geological data may include information collected from well logs, rock samples, outcroppings, micro-seismic imaging, or other data sources. In one or more embodiments, the data 212 include fracture data relating to fractures in the subterranean formation 702. The fracture data may identify the locations, sizes, shapes, and other properties of fractures in a model of a subterranean zone. The fracture data may include information on natural fractures, hydraulically-induced fractures, or any other type of discontinuity in the subterranean formation 702. The fracture data may include fracture planes calculated from micro-seismic data or other information. For each fracture plan, the fracture data may include information (for example, strike angle, dip angle, etc.) identifying an orientation of the fracture, information identifying a shape (for example, curvature, aperture, etc.) of the fracture, information identifying boundaries of the fracture, or any other suitable information.

The one or more applications 210 may comprise one or more software applications, one or more scripts, one or more programs, one or more functions, one or more executables, or one or more other modules that are interpreted or executed by the processor 202. For example, the one or more applications 210 may include a fracture design module, a reservoir simulation tool, a hydraulic fracture simulation model, or any other appropriate function block. The one or more applications 210 may include machine-readable instructions for performing one or more of the operations related to any one or more embodiments of the present disclosure. The one or more applications 210 may include machine-readable instructions for generating a user interface or a plot, for example, illustrating fracture geometry (for example, length, width, spacing, orientation, etc.), pressure plot, hydrocarbon production performance. The one or more applications 210 may obtain input data, such as treatment data, geological data, fracture data, or other types of input data, from the memory 206, from another local source, or from one or more remote sources (for example, via the one or more communication links 214). The one or more applications 210 may generate output data and store the output data in the memory 206, hard drive 208, in another local medium, or in one or more remote devices (for example, by sending the output data via the communication link 214).

Memory controller hub 204 may include a memory controller for directing information to or from various system memory components within the information handling system 200, such as memory 206, storage element 216, and hard drive 208. The memory controller hub 204 may be coupled to memory 206 and a graphics processing unit (GPU) 218. Memory controller hub 204 may also be coupled to an I/O controller hub (ICH) or south bridge 220. I/O controller hub 220 is coupled to storage elements of the information handling system 200, including a storage element 216, which may comprise a flash ROM that includes a basic input/output system (BIOS) of the computer system. I/O controller hub 220 is also coupled to the hard drive 208 of the information handling system 200. I/O controller hub 220 may also be coupled to an I/O chip or interface, for example, a Super I/O chip 222, which is itself coupled to several of the I/O ports of the computer system, including a keyboard 224, a mouse 226, a monitor or display 228 and one or more communications link 214. Any one or more input/output devices receive and transmit data in analog or digital form over one or more communication links 614 such as a serial link, a wireless link (for example, infrared, radio frequency, or others), a parallel link, or another type of link. The one or more communication links 214 may comprise any type of communication channel, connector, data communication network, or other link. For example, the one or more communication links 214 may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to FIG. 2 without departing from the scope of the present disclosure. For example, FIG. 2 shows a particular configuration of components of information handling system 200. However, any suitable configurations of components may be used. For example, components of information handling system 200 may be implemented either as physical or logical components. Furthermore, in some embodiments, functionality associated with components of information handling system 200 may be implemented in special purpose circuits or components. In other embodiments, functionality associated with components of information handling system 200 may be implemented in configurable general-purpose circuit or components. For example, components of information handling system 200 may be implemented by configured computer program instructions.

Figure 3:
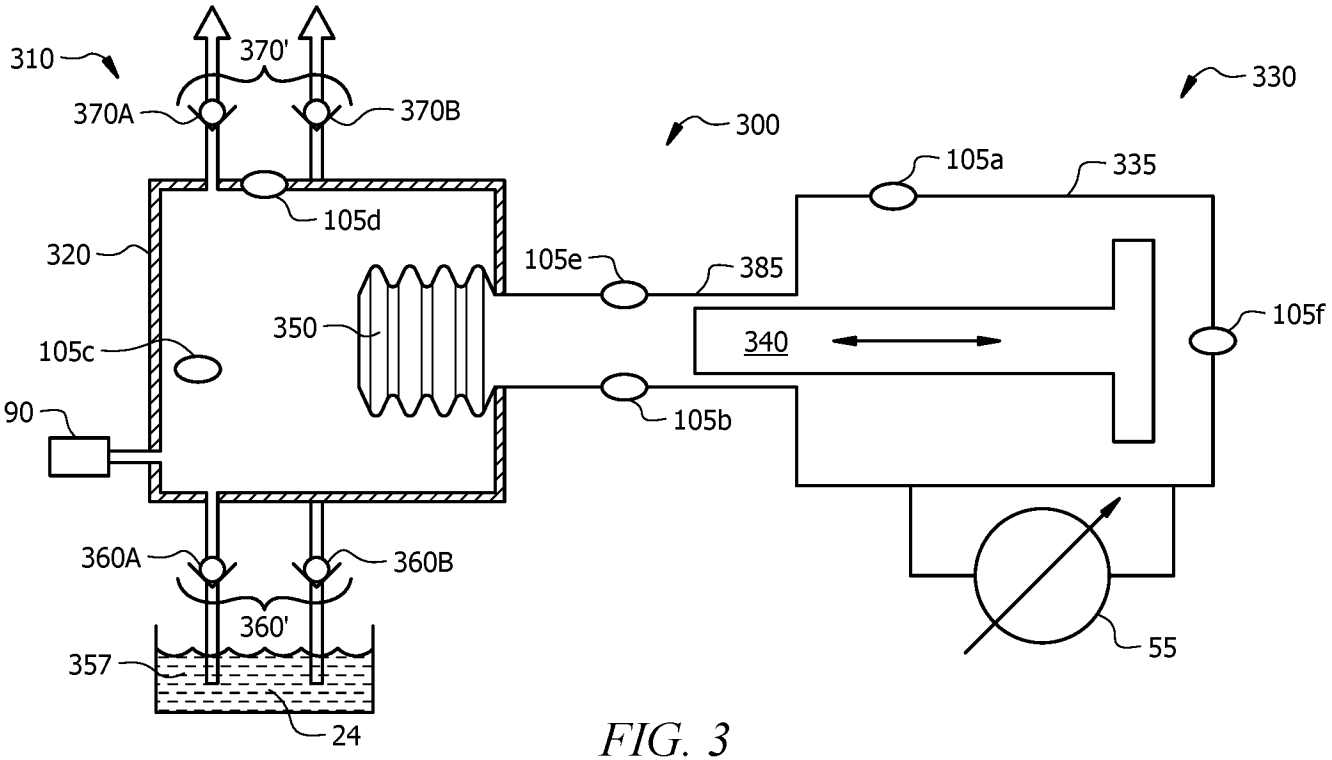
FIG. 3 is a schematic diagram of an example bellows pump, according to one or more aspects of the present disclosure, depicting some suitable sensor locations.

FIG. 3 illustrates an example bellows pump 300, according to embodiments of this disclosure, and will be used to show possible positions for one or more sensors 105 and methods control system 108 can utilize the measurements from such sensors 105 to control operation of a pump 100/300. In embodiments, the bellows pump 300 may be used as the one or more pumps 100 (referring to FIGS. 1A-1E) in a fracturing system 610 (described hereinbelow with reference to FIG. 6). As described with reference to pump 100 of FIGS. 1A-1E, the bellows pump 300 may use a bellow(s) 350 as a means to segregate the desired pumped fluid 54, or in particular, proppant laden fluid, from the hydraulic structure or system of the pump power end 330. The present disclosure may provide a way to monitor valve health in real-time and switch between valves of a redundant valve 60'/70' as indicated. The bellows pump 300 comprises bellows housing 320 configured to at least partially contain the bellows 350, wherein the bellows 350 is used to provide treatment fluid 24 flow. The bellows housing 320 can define the fluid end 310 of the bellows pump 300. First suction valve 360A and second suction valve 360B of redundant suction valve 360 can be disposed upstream to allow incoming treatment fluid flow and a first discharge valve 370A and second discharge valve 370B of redundant discharge valve 370 can be disposed downstream to discharge pressurized treatment fluid 24 flow. The first and second suction valves 360A/360B and the first and second discharge valves 370A/370B can be one-way check valves. In alternate embodiments, any other suitable valve may be used as the valves 360A, 360B, 370A, 370B. As illustrated, the bellows pump 300 may be coupled to a pressure intensifier 335, wherein the pressure intensifier 335 may be configured to increase the hydraulic pressure produced by the bellows pump 300. In embodiments, the pressure intensifier 335 may be integrated into the bellows pump 300. The pressure intensifier 335 may comprise a piston 340 operable to translate within a body 385 (or reciprocating element bore) disposed between the pressure intensifier 335 and bellows housing 320 to increase the hydraulic pressure. In embodiments, the body 385 may be a cylinder.

In embodiments, pump 100 may be an intensifier-type pump that can be deployed in order to pump the treatment (e.g., stimulation) fluid downhole. Intensifier-type pumps use the concept of pressure intensification or amplification to generate a desired pressure. These pumps can be used to pump treatment fluids such as water. In some contexts, these pumps may be used to pump other treatment fluids such as mixtures of water, sands, or other liquids. The intensifier provides a desired reciprocating movement of a bellows 50/350 that may be in a casing and causes the pump 100/300 to pull in the treatment fluid 24 from a reservoir (e.g., slurry reservoir 357 of FIG. 3 or treatment fluid 24 producing apparatus 620 of FIG. 6, described hereinbelow) and push out the fluid with each movement. Depending upon the application, the contents of the treatment fluid 24 may be corrosive or abrasive that may damage the pump if the treatment fluid comes in contact with the mechanical or electrical components of the pump 100/300. As discussed hereinabove with reference to FIG. 1E, a hydraulic fluid system 55 can be utilized to drive the reciprocating element 40/340.

FIG. 3 is being utilized to further illustrate suitable positions for the one or more sensors 105 providing input(s) 109 to control system 108. As illustrated, there may be one or more pressure, flowrate, and/or position sensors 105, with sensors 105A-105F shown in FIG. 3, disposed on the bellows housing 20/320, on the reciprocating element bore 85/385, on the pressure intensifier or pump body 35/335 of the power end 30/330, and any other suitable location. In embodiments, there may be a position sensor 105 disposed on the bellows 50/350 contained within the bellows housing 20/320. The one or more sensors 105 may measure parameters related to operation of the bellows pump 100/300 with reference to corresponding operation of associated valves (such as first suction valve 60A/360A, second suction valve 60B/360B, first discharge valve 70A/370A and second discharge valve 70B/370B). The position of the bellows 50/350 within the bellows housing 20/320 in relation to the position of the reciprocating element (e.g., piston) 40/340 may be correlated and monitored. The control system 108 of FIGS. 1A-1E may compare the position of the bellows 50/350 and piston/reciprocating element 40/340 and create alerts and/or make physical adjustment (by way of actuated valves, such as first suction valve 60A/360A, second suction valve 60B/360B, first discharge valve 70A/370A, second discharge valve 70B/370B, or other suitable valves) to the volume of power fluid 54 providing the coupling between the two in order to adjust the timing.

The relation of position of the bellows 50/350 and pressure intensifier or pump body 35/335 may be used to determine leak of the bellows 50/350 by comparing expected position with actual position. In certain embodiments, head position of a hydraulic motor(s) used to drive the pressure intensifier of the power end 30/330 may be used to correlate its position. If the actual position does not follow the expected position, a determination may be made that there is leakage in the fluid coupling between the two.

Figure 4:
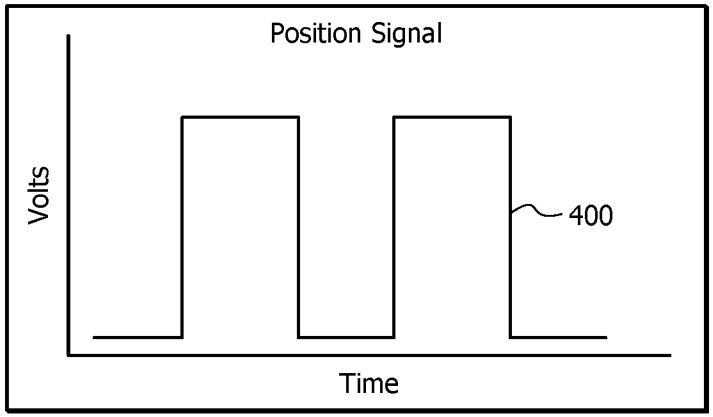
FIG. 4 illustrates a graph of position over time, according to one or more aspects of the present disclosure.

FIG. 4 illustrates a graph showing a position signal 400 generated by one of the position sensors 105 of FIGS. 1A-1F or FIG. 3 during operation of the pump 100 of FIGS. 1A-1F or pump 300 of FIG. 3. In certain embodiments, the position signal 400 may be shown on a display unit of the control system 180 of FIGS. 1A-1E. FIG. 4 shows a position signal 400 displayed in volts over time (in seconds). The position signal 400 may be generated by one of the position sensors 105 positioned on the reciprocating element (e.g., piston) 40/340 of the pressure intensifier or power end 335 and/or positioned on the bellows 50/350 contained within the bellows housing 20/320. The position signal 400 may represent the timing for opening and closing of a valve (such as first suction valve 60A/360A, second suction valve 60B/360B, first discharge valve 70A/370A, second discharge valve 70B/370B, or other suitable valves) over the indicated time as the bellows 50/350 operate.

Figure 5B:
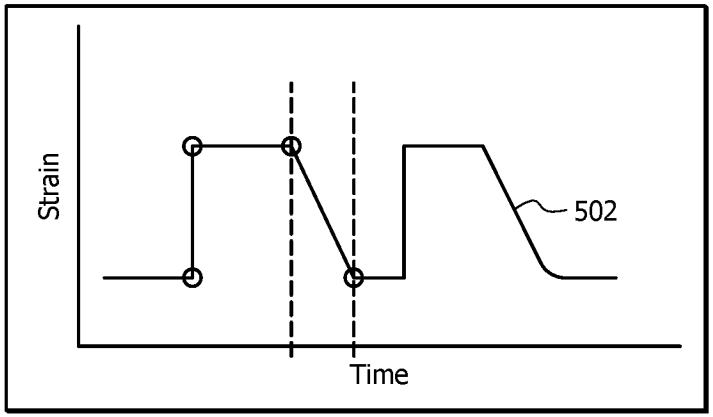
FIGS. 5A, 5B, and 5C each illustrates a graph of strain over time, according to one or more aspects of the present disclosure.
Figure 5A:
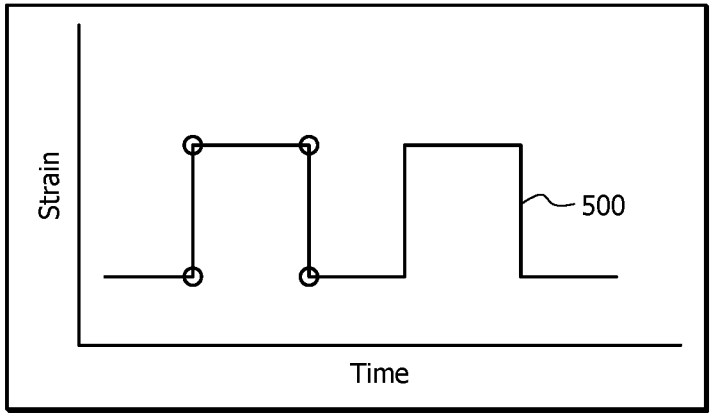
Figure 5C:
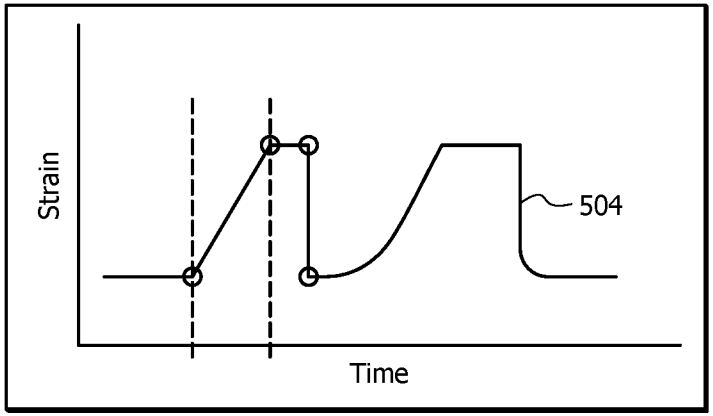

FIGS. 5A, 5B, and 5C each illustrates a graph of strain over time. FIG. 5A illustrates a strain signal 500 during ordinary operations as received by the control system 180 (referring to FIGS. 1A-1F) for a healthy pump. FIG. 5B illustrates a strain signal 502 of an example of a discharge valve 70/370 leak which creates a longer strain decay over time for each strain cycle. FIG. 5C illustrates a strain signal 504 of an example of a suction valve 60/360 leak which creates a longer strain rise to peak strain. Referring to each of FIGS. 5A-5C, the example notations each represent key timing in valve opening/closing position. In one or more embodiments, the control system 108 may receive and process signals from the one or more sensors 105 (referring to FIGS. 1A-1F and FIG. 3) to determine the opening and closing of the slurry valves (i.e., first suction valve 60A/360A, second suction valve 60B/360B, first discharge valve 70A/370A, second discharge valve 70B/370B), determine the position of the reciprocating element 40/340, and/or determine the position of the bellows 50/350 in the bellows housing 20/320.

Using this information, the control system 108 may determine the health of the slurry valves and/or bellows and relays the status to a display. In one or more embodiments, the control system 108 may display the processed signals in a graphical representation, such as strain signals 500, 502, and 504, generate and transmit an alert to a user or operator if there is leakage, actuate one or more valves, terminate operation of the bellows pump 100/300, or any combination thereof based on the received signals. In further embodiments, the received sensor measurements may be used to monitor other aspects of pump performance beyond valve leakage. For example, and without limitation, such measurements may monitor for cavitation of the bellows pump 100/300, incomplete fill with the corresponding fluid 24 at the fluid end 10/310, driver fluid 54 leakage within the pressure intensifier 308, and any combination thereof. As the control system 108 may continuously monitor parameters with respect to the bellows pump 100/300, the rate-of-change of sensed parameters may further be instructive of pump performance throughout both suction and discharge strokes.

The inputs 109 to the control system 108 can thus include data from a first sensor 105 representing a position of the bellows 50/350 at a first time and data from a second sensor 105 representing a position of the reciprocating element 40 at a first time. To determine that a valve 60/70 or the bellows 50/350 has failed or is failing, the control system 108 can be configured to compare the position of the bellows 50/350 and the position of the reciprocating element 40 to generate a relative position, and determine that the relative position is outside of a range or threshold value. Alternatively or additionally, data from a first sensor 105 can represent a pressure within the first volume 25A and data from a second sensor 105 can represent a pressure within the second volume 25B. To determine the valve 60/70 and/or bellows 50/350 has failed or is failing, the control system 108 can be configured to compare the pressure within the first volume 25A to the pressure within the second volume 25B to generate a value representing difference in pressure, and determine that the value representing difference in pressure is outside of a range or threshold value. The outputs 110 can include sending a notification to a device (e.g., a monitor or display 228) associated with an operator. The output 110 can comprise a command to turn off the pumps 100/300 or one or more auxiliary pumps, open or close suction or discharge valve, or close make up fluid circuit.

Figure 6:
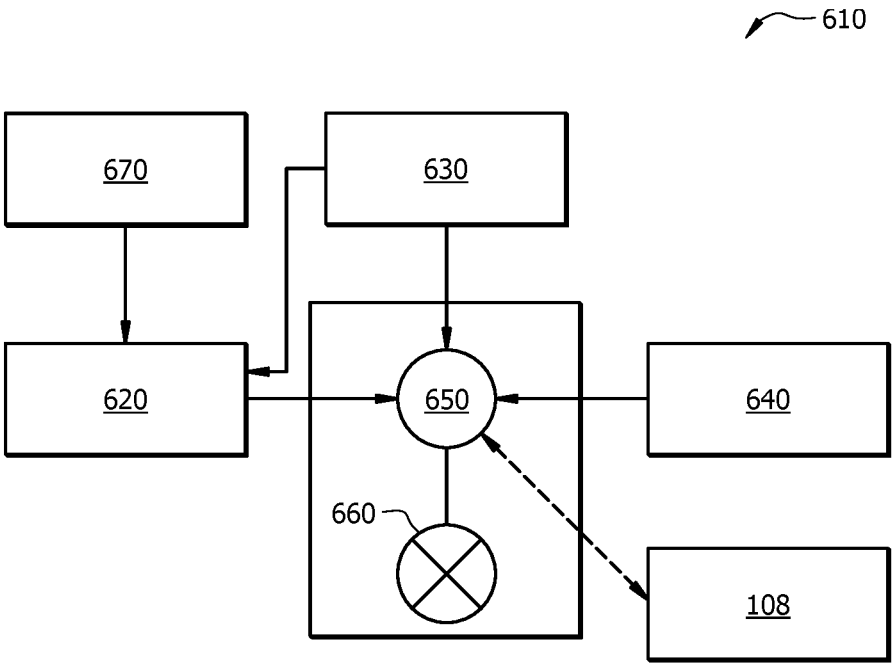
FIG. 6 is a schematic diagram of an example fracturing system that can employ one or more pumps of this disclosure, according to one or more aspects of the present disclosure.

FIG. 6 illustrates an example fracturing system 610, according to embodiments of this disclosure, which can employ a pumping system I/II/III of this disclosure. The example fracturing system 610 may be implemented using the systems, methods, and techniques described herein. In particular, the disclosed system, methods, and techniques may directly or indirectly affect one or more components or pieces of equipment associated with the example fracturing system 610, according to one or more embodiments. The fracturing system 610 may comprise a fracturing fluid producing apparatus 620, a fluid source 630, a solid source 640, and a pump and blender system 650 comprising a pump 100/300 of this disclosure. All or an applicable combination of these components of the fracturing system 610 may reside at the surface at a well site/fracturing pad where a well 660 is located.

During a fracturing job, the fracturing fluid producing apparatus 620 may access the fluid source 630 for introducing/controlling flow of a fluid, e.g. a fracturing fluid, in the fracturing system 610. While only a single fluid source 630 is shown, the fluid source 630 may include a plurality of separate fluid sources. Further, the fracturing fluid producing apparatus 620 may be omitted from the fracturing system 610. In turn, the fracturing fluid may be sourced directly from the fluid source 630 during a fracturing job instead of through the intermediary fracturing fluid producing apparatus 620.

The fracturing fluid may be an applicable fluid for forming fractures during a fracture stimulation treatment of the well 660. For example, the fracturing fluid may include water, a hydrocarbon fluid, a polymer gel, foam, air, wet gases, and/or other applicable fluids. In various embodiments, the fracturing fluid may include a concentrate to which additional fluid is added prior to use in a fracture stimulation of the well 660. In certain embodiments, the fracturing fluid may include a gel pre-cursor with fluid, e.g. liquid or substantially liquid, from fluid source 30. Accordingly, the gel pre-cursor with fluid may be mixed by the fracturing fluid producing apparatus 620 to produce a hydrated fracturing fluid for forming fractures.

The solid source 640 may include a volume of one or more solids for mixture with a fluid, e.g. the fracturing fluid, to form a solid-laden fluid. The solid-laden fluid may be pumped into the well 660 as part of a solids-laden fluid stream that is used to form and stabilize fractures in the well 660 during a fracturing job. The one or more solids within the solid source 640 may include applicable solids that may be added to the fracturing fluid of the fluid source 630. Specifically, the solid source 640 may contain one or more proppants for stabilizing fractures after they are formed during a fracturing job, e.g. after the fracturing fluid flows out of the formed fractures. For example, the solid source 640 may contain sand.

The fracturing system 610 may also include additive source 670. The additive source 70 may contain/provide one or more applicable additives that may be mixed into fluid, e.g. the fracturing fluid, during a fracturing job. For example, the additive source 670 may include solid 10 suspension-assistance agents, gelling agents, weighting agents, and/or other optional additives to alter the properties of the fracturing fluid. The additives may be included in the fracturing fluid to reduce pumping friction, to reduce or eliminate the fluid's reaction to the geological formation in which the well is formed, to operate as surfactants, and/or to serve other applicable functions during a fracturing job. As will be discussed in greater detail later, the additives may function to maintain solid particle suspension in a mixture of solid particles and fracturing fluid as the mixture is pumped down the well 660 to one or more perforations.

The pump and blender system 650 functions to pump fracture fluid into the well 660. Specifically, the pump and blender system 650 may pump fracture fluid from the fluid source 630, e.g. fracture fluid that is received through the fracturing fluid producing apparatus 620, into the well 660 for forming and potentially stabilizing fractures as part of a fracture job. The pump and blender system 650 may include one or more pumps 100/300 of this disclosure. Specifically, the pump and blender system 650 may include a plurality of pumps 100/300 that operate together, e.g. concurrently, to form fractures in a subterranean formation as part of a fracturing job. The one or more pumps 100/300 included in the pump and blender system 650 may be an applicable type of fluid pump. For example, the pumps 100/300 in the pump and blender system 650 may include electric pumps and/or hydrocarbon and hydrocarbon mixture powered pumps. In certain embodiments, the pumps 100/300 in the pump and blender system 650 may include diesel powered pumps, natural gas powered pumps, electric pumps, pumps run with a combination of such fuels. One or more of the pumps 100/300 in pump and blender system 650 can be bellows pumps 100/300 of this disclosure.

The pump and blender system 650 may also function to receive the fracturing fluid and combine it with other components and solids. Specifically, the pump and blender system 650 may combine the fracturing fluid with volumes of solid particles, e.g. proppant, from the solid source and/or additional fluid and solids from the additive source 670. In turn, the pump and blender system 650 may pump the resulting mixture down the well 660 at a sufficient pumping rate to create or enhance one or more fractures in a subterranean zone, for example, to stimulate production of fluids from the zone. While the pump and blender system 660 is described to perform both pumping and mixing of fluids and/or solid particles, in various embodiments, the pump and blender system 650 may function to just pump a fluid stream, e.g. a fracture fluid stream, down the well 660 to create or enhance one or more fractures in a subterranean zone.

The pump and blender system 650 can be communicatively coupled to one or more monitoring devices, such as control system 108. The control system 108 may be used to control the flow of fluids, solids, and/or other compositions to the one or more pumps 100/300 of the pumping and blender system 650. The control system 108 may allow the pumping and blender system 650 to source from one, some or all of the different sources at a given time. In turn, the pumping and blender system 650 may provide just fracturing fluid into the well at some times, just solids or solid slurries at other times, and combinations of those components at other times. In further embodiments, the control system 108 may be configured to monitor the health of valves associated with each of the one or more pumps 100/300 and/or the bellows 50/350 component of each pump 100/300. The control system 108 may be configured to actual one or more valves, provide an alert, terminate operation of one of the pumps 100/300, or any combination thereof.

The control system 108 may receive and process data measurements from one or more sensors and display the processed data measurements via any suitable display or monitor. As discussed hereinabove, one or more sensors 105 can be communicatively coupled to the control system 108. The sensors 105 can be disposed in proximity to and upon the pumps 100/300 and may be configured to measure a parameter corresponding to operation of the pumps 100/300, as discussed hereinabove. The control system 108 may make a determination regarding the maintenance and health of each pump 100/300 based on measurements provided by the one or more sensors 105. The present disclosure may include pump and valve monitoring systems and operations as taught in the following U.S. Pat. Nos. 10,480,296; 10,895,254; 11,125,225; and/or 11,441,557, the disclosure of each of which is herein incorporated by reference for purposes not contrary to this disclosure.

Figure 7:
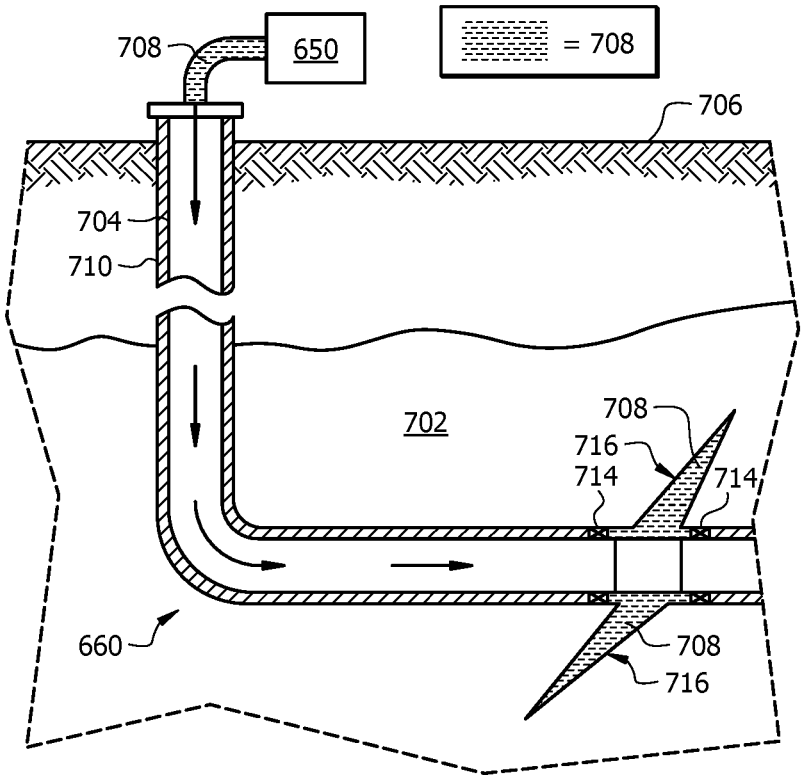
FIG. 7 is a schematic diagram of a well during an example fracturing operation in a portion of a subterranean formation of interest surrounding a wellbore, according to one or more aspects of the present disclosure.

FIG. 7 illustrates the well 660 during a fracturing operation in a portion of a subterranean formation of interest 702 surrounding a wellbore 704, according to embodiments of this disclosure. The fracturing operation may be performed using one or an applicable combination of the components in the example fracturing system 610 shown in FIG. 6. The wellbore 704 extends from a surface 706, and a fracturing fluid 708 (e.g., wellbore treatment fluid 24 of FIGS. 1A-1E) is applied to a portion of the subterranean formation 702 surrounding the horizontal portion of the wellbore 704. Although shown as vertical deviating to horizontal, the wellbore 704 may include horizontal, vertical, slant, curved, and other types of wellbore geometries and orientations, and the fracturing treatment may be applied to a subterranean zone surrounding any portion of the wellbore 104. The wellbore 704 may include a casing 710 that is cemented or otherwise secured to the wellbore wall. The wellbore 704 may be uncased or otherwise include uncased sections. Perforations may be formed in the casing 710 to allow fracturing fluids and/or other materials to flow into the subterranean formation 702. In the example fracture operation shown in FIG. 6, a perforation is created between points 714 defining an isolated zone.

The pump and blender system 650 may be fluidly coupled to the wellbore 704 to pump the fracturing fluid 708, and potentially other applicable solids and solutions into the wellbore 704. When the fracturing fluid 708 is introduced into wellbore 704, it may flow through at least a portion of the wellbore 704 to the perforation, defined by points 714. The fracturing fluid 708 may be pumped at a sufficient pumping rate through at least a portion of the wellbore 704 to create one or more fractures 716 through the perforation and into the subterranean formation 702. Specifically, the fracturing fluid 708 may be pumped at a sufficient pumping rate to create a sufficient hydraulic pressure at the perforation to form the one or more fractures 716. Further, solid particles, e.g. proppant from the solid source 640, may be pumped into the wellbore 704, e.g. within the fracturing fluid 708 towards the perforation. In turn, the solid particles may enter the fractures 716 where they may remain after the fracturing fluid flows out of the wellbore. These solid particles may stabilize or otherwise "prop" the fractures 716 such that fluids may flow freely through the fractures 716.

While only two perforations at opposing sides of the wellbore 704 are shown in FIG. 7, greater than two perforations may be formed in the wellbore 704, e.g. along the top side of the wellbore 704, as part of a perforation cluster. Fractures may then be formed through the plurality of perforations in the perforation cluster as part of a fracturing stage for the perforation cluster. Specifically, fracturing fluid and solid particles may be pumped into the wellbore 704 and pass through the plurality of perforations during the fracturing stage to form and stabilize the fractures through the plurality of perforations.

With reference to FIGS. 1-6, a method of pumping will be described. In one or more embodiments, the control system 108 may be provided at the well 660 to monitor the one or more pumps of pump and blender system 650, wherein one or more bellows pump 100/300 of this disclosure can be utilized. The control system 108 may receive measured parameters ("measurements") from the one or more sensors 105. In response, the control system 108 can determine whether there is leakage associated with operation of the bellows pump based on the received sensor 105 measurements. The control system 108 can then display the processed signals in a graphical representation, such as position signal 400, strain signals 500, 502, and 504, position signals, pressure signals, etc., generate and transmit an alert to a user or operator if there is leakage or valve insufficiency or failure, actuate one or more valves (e.g., actuate an offline valve of a redundant valve 60'/70' set in view of a failing valve, which can be placed offline), terminate operation of the bellows pump 100/300, or any combination thereof based on the received signals.

Accordingly, a method of operating a pumping system I/II/III can comprise: positioning the pump 100/300 at a wellsite 660 that comprises at least one wellbore 704 that penetrates at least a portion of a subterranean formation 702; pumping, with the pump 100/300, a fluid 24 (e.g., a fracturing fluid) into the wellbore 704 at or above an operating pressure (e.g., a pressure sufficient to create or enhance one or more fractures 716 in at least a portion of the subterranean formation 702), wherein pumping comprises pumping with the one/online valve (e.g., first suction valve 60A/360A, first discharge valve 70A/370A, or a combination thereof) of the redundant valve (e.g., of redundant suction 60'/360' or redundant discharge valve 70'/370'); and monitoring the one or more sensors 105 to determine when one/online valve of a redundant valve 60'/360'/70'/370' in operation is in need of repair or replacing; and switching to pumping with the another/offline valve (e.g., second suction valve 60B/360B, second discharge valve 70B/370B, or a combination thereof) of the redundant valve 60'/360'/70'/370'.

As described hereinabove, the system can include a redundant suction valve 60'/360' comprising at least two suction valves 60, a redundant discharge valve 70'/370' comprising at least two discharge valves 70, or both a redundant suction valve 60'/360' and a redundant discharge valve 70'/370'. In embodiments, each of the one or more suction valves 60/360, each of the one or more discharge valves 70/370, or a combination thereof is independently positioned external to or internal the bellows housing 20/320. The pump 100/300 can further comprise a suction control valve 65 associated with each of the one or more suction valves 60 and a discharge control valve 75 associated with each of the one or more discharge valves 70. As described hereinabove with reference to FIG. 1A-1C, each of the suction valves 60/360 can be positioned between the bellows housing 20/320 and the suction control valve 65 associated therewith, each of the discharge valves 70/370 can be positioned between the bellows housing 20/320 and the discharge control valve 75 associated therewith, or each of the suction valves 60/360 can be positioned between the bellows housing 20/320 and the suction control valve 65 associated therewith and each of the discharge valves 70/370 can be positioned between the bellows housing 20/320 and the discharge control valve 75 associated therewith. Alternatively, as described hereinabove with reference to FIG. 1D, which shows an alternative way to setup the pump 100/300 by changing positions with the control valves 65/75 and/or pressure relief device(s) 90, each of the suction control valves 65 can be positioned between the bellows housing 20/320 and the suction valve 60/360 with which it is associated, each of the discharge control valves 75 can be positioned between the bellows housing 20/320 and the discharge valve 70/370 with which it is associated, or each of the suction control valves 65 can be positioned between the bellows housing 20/320 and the suction valve 60/360 with which it is associated and each of the discharge control valves 75 can be positioned between the bellows housing 20/320 and the discharge valve 70/370 with which it is associated.

As described hereinabove with reference to FIG. 1E, which shows an alternative design to put valves in series or parallel and have them electrically actuated to eliminate the need for specific control valves, the one or more suction valves 60 can comprise at least two electrically actuated suction valves 60, the one or more discharge valves 70 can comprise at least two electrically actuated discharge valves 70, or the one or more suction valves 60 can comprise at least two electrically actuated suction valves 60 and the one or more discharge valves 70 can comprise at least two electrically actuated discharge valves 70. The at least two electrically actuated suction valves 60, the at least two electrically actuated discharge valves 70, or the at least two electrically actuated suction valves 60 and the at least two electrically actuated discharge valves 70 can be in series or in parallel.

In the methods and systems of the present disclosure, one or more bellows pumps 100/300 can be operated and used, either alone or in combination with other pumps, to pressurize a treatment fluid 24 and/or introduce the treatment fluid 24 into a well bore 704 (FIG. 7) penetrating at least a portion of a subterranean formation 702 (FIG. 7) to perform a treatment therein. In such bellows pumps 100/300, an expandable bellows 50/350 can be used inside a pump fluid end 10 (e.g., as described in U.S. Pat. No. 5,308,230, which is incorporated herein by reference) to separate a driving fluid 54 from a treatment fluid 24 used in a well treatment operation (such as a fracturing operation). The driving fluid 54 may be chosen from a desirable group of liquids such as water or hydraulic oil, and, in the case of a fracturing operation or fracturing pump, the treatment fluid 24 may be a fracturing fluid that comprises a base fluid (e.g., water, oils, organic liquids, etc.) as well as any other suitable components or additives useful for the fracturing treatment. For example, the fracturing fluid may be a slurry containing sand or synthetic proppants and a variety of chemical additives such as gelling agents, acids, friction reducers, and solvents.

The bellows pump 100/300 according to certain embodiments of the present disclosure may comprise a control (or "valve management") system 108, as described hereinabove, that includes one or more check valves 60/70, 360/370 that allow the treatment fluid 24 to flow in a selected direction within the bellows pump 100/300. The bellows pump 100/300 can include at least a suction valve 60/360 and a discharge valve 70/370, and includes a redundant set (e.g., at least two) of either the suction valves 60/360, the discharge valves 70/370, or includes a redundant set of both the suction valves and discharge valves. The suction valve 60/360 and/or the discharge valve 70/370 can comprise a one-way check valve that only allows the treatment fluid 24 to flow downstream of the bellows 50/350.

As described hereinabove, bellows pump 100/300 can comprise a fluid end body 10/310 with an interior cavity or volume 25. In the operation of the bellows pump 100/300, the driving fluid 54 is separated from the treatment fluid 24 by bellows 50/350, which may be comprised of a thin flexible material that separates the interior volume 25 into at least a first volume 25A and a second volume 25B. In embodiments, the bellows 50/350 may not be designed to withstand significant pressure differentials between the first volume 25A and the second volume 25B. Instead, the bellows 50/350 can serve as a fluid separating barrier between first volume 25A for driving fluid 54 and second volume 25B for treatment fluid 24. During operation of the bellows pump 100/300, the bellows 50/350 can flex axially (e.g., along central axis 45) to keep pressure balanced between first volume 25A and second volume 25B during operation. On a discharge stroke, as driving fluid 54 enters first volume 25A, the bellows 50/350 inflates and treatment fluid 24 is expelled from second volume 25B via an online discharge valve 70. Once the discharge stroke is complete, a suction stroke begins. During the suction stroke, driving fluid 54 inside first volume 25A exits first volume 25A, causing the bellows 50/350 to deflate. Treatment fluid 24 is thus drawn through an online suction valve 60 into second volume 25B. Once the bellows 50/350 is compressed to its minimum desired length, another discharge stroke begins.

As detailed hereinabove, in wellbore operations, such as hydraulic fracturing operations, high pressure pumps are used to pump a slurry mixture, such as a mixture of proppant or sand mixed with water or processed water, into a wellbore or formation (e.g., a shale formation). These operations use of a variety of pump types, including hydraulic intensifier and positive displacement pumps, to pump pressurized fluid. Both hydraulic intensifiers and positive displacement pumps use a reciprocating element or plunger to move fluid. Some of these pumps, such as a hydraulic intensifier, can be difficult to package requiring lots of piping. These pumps also require the use of suction and discharge valves or "check valves" to keep the fluid moving in the proper directions. When piping or manifolding is used instead of a traditional fluid end, the check valves can be mounted in complex piping. This complex piping can result in extended amounts of time to remove or replace check valves during routine or non-routine maintenance. The herein disclosed system and method provide a solution to continue operating upon determination of a bad check valve (via use of another valve of a redundant valve set) until the pump can be shut down for maintenance by having a control system 108 monitoring the pump(s) 100/300, which control system 108 can detect valve 60/70, 360/370 performance and manage the valves (e.g., via a control valve(s) 65/75) to select a pair of suction and discharge valves that are operable.

This disclosure provides a pumping system having additional valving and controls to provide a way to extend maintenance and prevent shutting down of a pump during operations. By providing for the ability to detect when suction or discharge (e.g., check) valves fail and enabling switching to a known good set of valves, the herein disclosed pump, systems, and methods can provide for extended run time, reduced non-productive time, additional methods to trouble shoot valve performance, or a combination thereof.

The disclosed system and method enable switching between bad and good valves of redundant valve sets to continue operation when a check valve (e.g., a suction and/or discharge valve) fails. The system and method can also be utilized to optimize valve life and/or to warn an operator (e.g., via sound/alert, graphical display, etc.) of valve performance and when the pumping system is running on back up valves (e.g., when a subsequent valve failure could mandate maintenance). In embodiments, the disclosed system and method provide for placing valves in series or in parallel and optionally having them electrically actuated to eliminate the need for specific control valves, in some embodiments.

Additional Disclosure

The following are non-limiting, specific embodiments in accordance with the present disclosure:

In a first embodiment, a pump comprises: a fluid end comprising a bellows housing having an interior volume; a power end comprising a pump body; a reciprocating element having a first end and a second end along a central axis thereof, wherein the first end of the reciprocating element is distal a back of the power end along the central axis relative to the back end of the reciprocating element which is proximal the back of the power end along the central axis relative to the front end of the reciprocating element; a bellows disposed at least partially within the bellows housing and dividing the interior volume of the bellows housing into a first volume interior to the bellows and a second volume exterior to the bellows, one or more suction valves, wherein each of the one or more suction valves is fluidly coupled to the second volume of the bellows housing; and one or more discharge valves, wherein each of the one or more discharge valves is fluidly coupled to the second volume of the bellows housing; wherein the reciprocating element moves away from and toward the back of the power end, through an inlet of the bellows housing, during operation of the pump and the bellows expands and contracts with the reciprocation of the reciprocating element respectfully away from and toward the back of the power end during operation of the pump, and wherein the one or more suction valves, the one or more discharge valves, or both the one or more suction valves and the one or more discharge valves comprise a redundant valve, wherein the redundant valve comprises at least two of said valves, wherein, during normal operation, one of the at least two said valves of the redundant valve is open/online while another of the at least two said valves of the redundant valve is closed/offline.

A second embodiment can include the pump of the first embodiment, wherein the reciprocating element comprises a plunger or an intensifier.

A third embodiment can include the pump of the first or the second embodiment, wherein the redundant valve comprises a redundant suction valve including a first suction valve and a second suction valve, a redundant discharge valve comprising a first discharge valve and a second discharge valve, or both a redundant suction valve and a redundant discharge valve.

A fourth embodiment can include the pump of the third embodiment, wherein the first suction valve, the second suction valve, the first discharge valve, the second discharge valve, or a combination thereof is independently positioned external to the bellows housing or internal to the bellows housing.

A fifth embodiment can include the pump of any one of the first to fourth embodiments, comprising multiple bellows associated with the reciprocating element.

A sixth embodiment can include the pump of any one of the first to fifth embodiments, wherein the pump is a reciprocating pump, an intensifier pump, a linear actuated pump, or a combination thereof.

A seventh embodiment can include the pump of any one of the first to sixth embodiments, wherein the pump is a single action intensifier pump or a dual action intensifier pump.

An eighth embodiment can include the pump of any one of the first to seventh embodiments further comprising a suction control valve associated with each of the one or more suction valves, a discharge control valve associated with each of the one or more discharge valves, or a combination thereof.

A ninth embodiment can include the pump of the eighth embodiment, wherein each of the one or more suction valves is positioned between the suction control valve associated therewith and the bellows housing, wherein each of the one or more discharge valves is positioned between the discharge control valve associated therewith and the bellows housing, or wherein each of the one or more suction valves is positioned between the suction control valve associated therewith and the bellows housing and wherein each of the one or more discharge valves is positioned between the discharge control valve associated therewith and the bellows housing.

A tenth embodiment can include the pump of the eighth or ninth embodiment, wherein each of the suction control valves is positioned between the suction valve with which it is associated and the bellows housing, wherein each of the one or more discharge control valves is positioned between the discharge valve with which it is associated and the bellows housing, or wherein each of the suction control valves is positioned between the suction valve with which it is associated and the bellows housing and wherein each of the one or more discharge control valves is positioned between the discharge valve with which it is associated and the bellows housing.

An eleventh embodiment can include the pump of any one of the first to tenth embodiments, wherein the one or more suction valves comprise at least two electrically actuated suction valves, wherein the one or more discharge valves comprise at least two electrically actuated discharge valves, or wherein the one or more suction valves comprise at least two electrically actuated suction valves and the one or more discharge valves comprise at least two electrically actuated discharge valves.

A twelfth embodiment can include the pump of the eleventh embodiment, wherein the at least two electrically actuated suction valves, the at least two electrically actuated discharge valves, or the at least two electrically actuated suction valves and the at least two electrically actuated discharge valves are in series.

A thirteenth embodiment can include the pump of the eleventh or twelfth embodiment, wherein the at least two electrically actuated suction valves, the at least two electrically actuated discharge valves, or the at least two electrically actuated suction valves and the at least two electrically actuated discharge valves are in parallel.

A fourteenth embodiment can include the pump of any one of the first to thirteenth embodiments further comprising a reciprocating element seal between the reciprocating element and a front wall of the pump body, and within a reciprocating element bore extending from the front wall of the pump body to the inlet of the bellows housing, wherein the reciprocating element reciprocates within the reciprocating element bore, and wherein the reciprocating element bore comprises the makeup/driving/hydraulic fluid.

A fifteenth embodiment can include the pump of any one of the first to fourteenth embodiments, wherein the pump operates during pumping of a wellbore servicing fluid at a pressure of greater than or equal to about 1,000 psi, 3,000 psi, 5,000 psi, 10,000 psi, 20,000 psi, 30,000 psi, 40,000 psi, or 50,000 psi, or a range thereamong (e.g., from about 1,000 psi to about 50,000 psi).

A sixteenth embodiment can include the pump of any one of the first to fifteenth embodiments, wherein the pump is a high pressure pump that operates, during the pumping of a wellbore servicing fluid comprising solid particulates, at a volumetric flow rate of greater than or equal to about 1, 3, 10, or 20 barrels per minute (BPM), or in a range of from greater than 0 to about 20 BPM, about 3 to about 20 BPM, from about 10 to about 20 BPM, or from about 5 to about 20 BPM.

A seventeenth embodiment can include the pump of the sixteenth embodiment, wherein the solid particulates comprise sand, proppant, drill cutting, or a combination thereof.

An eighteenth embodiment can include the pump of any one of the first to seventeenth embodiments, wherein each of the one or more suction valves, each of the one or more discharge valves, or a combination thereof comprises a check valve.

A nineteenth embodiment can include the pump of any one of the first to eighteenth embodiments, wherein the pump is a hydraulic intensifier unit designed and/or controlled as disclosed in U.S. Pat. Nos. 11,286,920; 11,268,503; 11,401,792, the disclosure of each of which is hereby incorporated herein for purposes no contrary to this disclosure.

A twentieth embodiment can include the pump of any one of the first to nineteenth embodiments further comprising at least one pressure relief valve.

A twenty first embodiment can include the pump of the twentieth embodiment, wherein the at least one pressure relief valve comprises: a pressure relief valve on a line fluidly connecting a line on which the one of the at least two said valves of the redundant valve is located and a line on which the another of the at least two said valves of the redundant valve is located; a pressure relief valve on a line extending from or otherwise coupled with the bellows housing; or a combination thereof.

A twenty second embodiment can include the pump of the twenty first embodiment, comprising a redundant suction valve and a redundant discharge valve, and wherein the at least one pressure relief valve comprises a pressure relief valve on a line fluidly connecting a first suction flow line on which one of the at least two suction valves of the redundant suction valve is located and a second suction flow line on which the another of the at least two suction valves of the redundant suction valve is located; and a pressure relief valve on a line fluidly connecting a first discharge flow line on which one of the at least two discharge valves of the redundant discharge valve is located and a second discharge flow line on which the another of the at least two discharge valves of the redundant discharge valve is located.

A twenty third embodiment can include the pump of any of the first to twenty second embodiments, wherein the pump has a stroke of from about 1 to about 10 feet (e.g., greater than or equal to about 5 feet) and a reciprocation rate of from about 1 to 100 strokes per minute, wherein the stroke is a difference between a fully extended position and a fully retracted position of the reciprocating element.

In a twenty fourth embodiments, a pumping system comprises: the pump of any one of the first to twenty third embodiments; a control system; and one or more sensors associated with the pump, wherein the control system comprises one or more processors and a non-transitory computer readable media coupled to the one or more processors having instructions stored thereon that, when executed by the one or more processors, causes the control system to: monitor (e.g., receive input from) the one or more sensors associated with the pump; and control (e.g., via an output), based on the input, operation of the one or more suction valves, the one or more discharge valves, or a combination thereof.

A twenty fifth embodiment can include the pumping system of the twenty fourth embodiment, wherein the control system controls the operation of the one or more suction valves, the one or more discharge valves, or the combination thereof by opening the another of the said valves of the redundant valve and subsequently closing the one of the said valves of the redundant valve upon determination that the one of the said valves is failing or has failed.

A twenty sixth embodiment can include the pumping system of the twenty fourth or twenty fifth embodiment, wherein the one or more sensors comprise: a sensor configured to determine a pressure of a first fluid (e.g., a wellbore treatment fluid) in the first volume; a sensor configured to determine a pressure of a second fluid (e.g., a makeup/driving/hydraulic fluid) in the second volume; a sensor configured to determine a flow rate of the first fluid, the second fluid, or both; a sensor configured to determine a position of the bellows (e.g., a distance the bellows extends into the fluid housing from the inlet thereof); a sensor configured to determine a temperature of the first fluid; a sensor configured to determine a temperature of the second fluid; a sensor configured to determine a viscosity of the first fluid; a sensor configured to determine a viscosity of the second fluid; or a combination thereof.

In a twenty seventh embodiment, a method of operating a pumping system of any one of the twenty fourth to twenty sixth embodiments comprises: positioning the pump at a wellsite that comprises at least one wellbore that penetrates at least a portion of a subterranean formation; pumping, with the pump, a fluid (e.g., a fracturing fluid) into the wellbore at or above an operating pressure (e.g., a pressure sufficient to create or enhance one or more fractures in at least a portion of the subterranean formation), wherein pumping comprises pumping with the one valve of the redundant valve; and monitoring the one or more sensors to determine when the one, online valve of the redundant valve in operation is in need of repair or replacing; and switching to pumping with the another, offline valve of the redundant valve.

A twenty eighth embodiment can include the method of the twenty seventh embodiment, comprising a redundant suction valve comprising at least two suction valves, a redundant discharge valve comprising at least two discharge valves, or both a redundant suction valve and a redundant discharge valve.

A twenty ninth embodiment can include the method of the twenty seventh or twenty eighth embodiment, wherein each of the one or more suction valves, each of the one or more discharge valves, or a combination thereof is independently positioned external to or internal the bellows housing.

A thirtieth embodiment can include the method of any one of the twenty seventh to twenty ninth embodiments, wherein the pump further comprises a suction control valve associated with each of the one or more suction valves and a discharge control valve associated with each of the one or more discharge valves.

A thirty first embodiment can include the method of the thirtieth embodiment, wherein each of the suction valves is positioned between the bellows housing and the suction control valve associated therewith, wherein each of the discharge valves is positioned between the bellows housing and the discharge control valve associated therewith, or wherein each of the suction valves is positioned between the bellows housing and the suction control valve associated therewith and each of the discharge valves is positioned between the bellows housing and the discharge control valve associated therewith.

A thirty second embodiment can include the method of the thirtieth or thirty first embodiment, wherein each of the suction control valves is positioned between the bellows housing and the suction valve with which it is associated, wherein each of the discharge control valves is positioned between the bellows housing and the discharge valve with which it is associated, or wherein each of the suction control valves is positioned between the bellows housing and the suction valve with which it is associated and each of the discharge control valves is positioned between the bellows housing and the discharge valve with which it is associated.

A thirty third embodiment can include the method of any one of the twenty seventh to thirty second embodiments, wherein the one or more suction valves comprise at least two electrically actuated suction valves, wherein the one or more discharge valves comprise at least two electrically actuated discharge valves, or wherein the one or more suction valves comprise at least two electrically actuated suction valves and the one or more discharge valves comprise at least two electrically actuated discharge valves.

A thirty fourth embodiment can include the method of the thirty third embodiment, wherein the at least two electrically actuated suction valves, the at least two electrically actuated discharge valves, or the at least two electrically actuated suction valves and the at least two electrically actuated discharge valves are in series.

A thirty fifth embodiment can include the method of the thirty third or thirty fourth embodiment, wherein the at least two electrically actuated suction valves, the at least two electrically actuated discharge valves, or the at least two electrically actuated suction valves and the at least two electrically actuated discharge valves are in parallel.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A pump comprising:

a fluid end comprising a bellows housing having an interior volume;

a power end comprising a pump body;

a reciprocating element having a first end and a second end along a central axis thereof, wherein the first end of the reciprocating element is distal a back of the power end along the central axis relative to the second end of the reciprocating element which is proximal the back of the power end along the central axis relative to the first end of the reciprocating element;

a bellows disposed at least partially within the bellows housing and dividing the interior volume of the bellows housing into a first volume interior to the bellows and a second volume exterior to the bellows, one or more suction valves, wherein each of the one or more suction valves is fluidly coupled to the second volume of the bellows housing;

one or more discharge valves, wherein each of the one or more discharge valves is fluidly coupled to the second volume of the bellows housing; and at least one pressure relief valve, wherein the reciprocating element moves away from and toward the back of the power end through an inlet of the bellows housing during operation of the pump, and the bellows expands and contracts with the reciprocation of the reciprocating element respectfully away from and toward the back of the power end during operation of the, wherein the one or more suction valves, the one or more discharge valves, or both the one or more suction valves and the one or more discharge valves comprise a redundant valve, wherein the redundant valve comprises at least two of said valves, wherein, during normal operation, one of the at least two said valves of the redundant valve is online while another of the at least two said valves of the redundant valve is offline, and wherein the at least one pressure relief valve is on a line fluidly connecting a line on which the one of the at least two said valves of the redundant valve is located and a line on which the another of the at least two said valves of the redundant valve is located.

2. The pump of claim 1, wherein the redundant valve comprises a redundant suction valve including a first suction valve and a second suction valve, a redundant discharge valve comprising a first discharge valve and a second discharge valve, or both a redundant suction valve and a redundant discharge valve.

3. The pump of claim 2, wherein the first suction valve, the second suction valve, the first discharge valve, the second discharge valve, or a combination thereof is independently positioned external to the bellows housing or internal to the bellows housing.

4. The pump of claim 1 further comprising a suction control valve associated with each of the one or more suction valves, a discharge control valve associated with each of the one or more discharge valves, or a combination thereof.

5. The pump of claim 4, wherein each of the one or more suction valves is positioned between the suction control valve associated therewith and the bellows housing, wherein each of the one or more discharge valves is positioned between the discharge control valve associated therewith and the bellows housing, or wherein each of the one or more suction valves is positioned between the suction control valve associated therewith and the bellows housing and wherein each of the one or more discharge valves is positioned between the discharge control valve associated therewith and the bellows housing.

6. The pump of claim 4, wherein each of the suction control valves is positioned between the suction valve with which it is associated and the bellows housing, wherein each of the one or more discharge control valves is positioned between the discharge valve with which it is associated and the bellows housing, or wherein each of the suction control valves is positioned between the suction valve with which it is associated and the bellows housing and wherein each of the one or more discharge control valves is positioned between the discharge valve with which it is associated and the bellows housing.

7. The pump of claim 1, wherein the one or more suction valves comprise at least two electrically actuated suction valves, wherein the one or more discharge valves comprise at least two electrically actuated discharge valves, or wherein the one or more suction valves comprise at least two electrically actuated suction valves and the one or more discharge valves comprise at least two electrically actuated discharge valves.

8. The pump of claim 1, further comprising at least two pressure relief valves on the line fluidly connecting the line on which the one of the at least two said valves of the redundant valve is located and the line on which the another of the at least two said valves of the redundant valve is located.

9. The pump of claim 1, further comprising another pressure relief valve on a line extending from or otherwise coupled with the bellows housing.

10. A pump comprising:

a fluid end comprising a bellows housing having an interior volume;

a power end comprising a pump body;

a reciprocating element having a first end and a second end along a central axis thereof, wherein the first end of the reciprocating element is distal a back of the power end along the central axis relative to the second end of the reciprocating element which is proximal the back of the power end along the central axis relative to the first end of the reciprocating element;

a bellows disposed at least partially within the bellows housing and dividing the interior volume of the bellows housing into a first volume interior to the bellows and a second volume exterior to the bellows, one or more suction valves, wherein each of the one or more suction valves is fluidly coupled to the second volume of the bellows housing;

one or more discharge valves, wherein each of the one or more discharge valves is fluidly coupled to the second volume of the bellows housing; and at least one pressure relief valve, wherein the reciprocating element moves away from and toward the back of the power end through an inlet of the bellows housing during operation of the pump, and the bellows expands and contracts with reciprocation of the reciprocating element respectfully away from and toward the back of the power end wherein the one or more suction valves and the one or more discharge valves comprise a redundant valve, wherein the redundant valve comprises at least two of said valves, wherein, during normal operation, one of the at least two said valves of the redundant valve is online while another of the at least two said valves of the redundant valve is offline, and wherein the at least one pressure relief valve comprises a pressure relief valve on a line fluidly connecting a first suction flow line on which one of the at least two suction valves of the redundant suction valve is located and a second suction flow line on which the another of the at least two suction valves of the redundant suction valve is located; and a pressure relief valve on a line fluidly connecting a first discharge flow line on which one of the at least two discharge valves of the redundant discharge valve is located and a second discharge flow line on which the another of the at least two discharge valves of the redundant discharge valve is located.

11. A pumping system comprising:

a pump;

a control system; and one or more sensors associated with the pump, wherein the pump comprises:

a fluid end comprising a bellows housing having an interior volume;

a power end comprising a pump body;

a reciprocating element having a first end and a second end along a central axis thereof, wherein the first end of the reciprocating element is distal a back of the power end along the central axis relative to the second end of the reciprocating element which is proximal the back of the power end along the central axis relative to the first end of the reciprocating element;

a bellows disposed at least partially within the bellows housing and dividing the interior volume of the bellows housing into a first volume interior to the bellows and a second volume exterior to the bellows, one or more suction valves, wherein each of the one or more suction valves is fluidly coupled to the second volume of the bellows housing;

one or more discharge valves, wherein each of the one or more discharge valves is fluidly coupled to the second volume of the bellows housing; and at least one pressure relief valve, wherein the reciprocating element moves away from and toward the back of the power end through an inlet of the bellows housing during operation of the pump, and the bellows expands and contracts with reciprocation of the reciprocating element respectfully away from and toward the back of the power end, wherein the one or more suction valves, the one or more discharge valves, or both the one or more suction valves and the one or more discharge valves comprise a redundant valve, wherein the redundant valve comprises at least two of said valves, wherein, during normal operation, one of the at least two said valves of the redundant valve is online while another of the at least two said valves of the redundant valve is offline, wherein the at least one pressure relief valve is on a line said valves of the redundant valve is offline, wherein the at least one pressure relief valve is on a line fluidly connecting a line on which the one of the at least two said valves of the redundant valve is located and a line on which the another of the at least two said valves of the redundant valve is located, and wherein the control system comprises one or more processors and a non-transitory computer readable media coupled to the one or more processors having instructions stored thereon that, when executed by the one or more processors, causes the control system to:

monitor the one or more sensors associated with the pump; and control, based on the input, operation of the one or more suction valves, the one or more discharge valves, or a combination thereof.

12. The pumping system of claim 11, wherein the control system controls the operation of the one or more suction valves, the one or more discharge valves, or the combination thereof by opening the another of the said valves of the redundant valve and subsequently closing the one of the said valves of the redundant valve upon determination that the one of the said valves is failing or has failed.

13. The pumping system of claim 11, wherein the one or more sensors comprise:

a sensor configured to determine a pressure of a first fluid in the first volume;

a sensor configured to determine a pressure of a second fluid in the second volume;

a sensor configured to determine a flow rate of the first fluid, the second fluid, or both;

a sensor configured to determine a position of the bellows;

a sensor configured to determine a temperature of the first fluid;

a sensor configured to determine a temperature of the second fluid;

a sensor configured to determine a viscosity of the first fluid;

a sensor configured to determine a viscosity of the second fluid; or a combination thereof.

14. A method of operating a pumping system comprising:

a pump;

a control system; and one or more sensors associated with the pump, wherein the pump comprises:

a fluid end comprising a bellows housing having an interior volume;

a power end comprising a pump body;

a reciprocating element having a first end and a second end along a central axis thereof, wherein the first end of the reciprocating element is distal a back of the power end along the central axis relative to the second end of the reciprocating element which is proximal the back of the power end along the central axis relative to the first end of the reciprocating element;

a bellows disposed at least partially within the bellows housing and dividing the interior volume of the bellows housing into a first volume interior to the bellows and a second volume exterior to the bellows, one or more suction valves, wherein each of the one or more suction valves is fluidly coupled to the second volume of the bellows housing; and one or more discharge valves, wherein each of the one or more discharge valves is fluidly coupled to the second volume of the bellows housing; wherein the reciprocating element moves away from and toward the back of the power end through an inlet of the bellows housing during operation of the pump, and the bellows expands and contracts with the reciprocation of the reciprocating element respectfully away from and toward the back of the power end, and wherein the one or more suction valves, the one or more discharge valves, or both the one or more suction valves and the one or more discharge valves comprise a redundant valve, wherein the redundant valve comprises at least two of said valves, wherein, during normal operation, one of the at least two said valves of the redundant valve is online while another of the at least two said valves of the redundant valve is offline, wherein the control system comprises one or more processors and a non-transitory computer readable media coupled to the one or more processors having instructions stored thereon that, when executed by the one or more processors, causes the control system to:

monitor the one or more sensors associated with the pump; and control, based on the input, operation of the one or more suction valves, the one or more discharge valves, or a combination thereof, the method comprising:

positioning the pump at a wellsite that comprises at least one wellbore that penetrates at least a portion of a subterranean formation;

pumping, with the pump, a fluid into the wellbore at or above an operating pressure, wherein pumping comprises pumping with the one valve of the redundant valve;

monitoring the one or more sensors to determine when the one, online valve of the redundant valve in operation is in need of repair or replacing; and switching to pumping with the another, offline valve of the redundant valve.

15. The method of claim 14, comprising a redundant suction valve comprising at least two suction valves, a redundant discharge valve comprising at least two discharge valves, or both a redundant suction valve and a redundant discharge valve.

16. The method of claim 14, wherein each of the one or more suction valves, each of the one or more discharge valves, or a combination thereof is independently positioned external to or internal the bellows housing.

17. The method of claim 14, wherein the pump further comprises a suction control valve associated with each of the one or more suction valves and a discharge control valve associated with each of the one or more discharge valves.

18. The method of claim 17, wherein each of the suction valves is positioned between the bellows housing and the suction control valve associated therewith, wherein each of the discharge valves is positioned between the bellows housing and the discharge control valve associated therewith, or wherein each of the suction valves is positioned between the bellows housing and the suction control valve associated therewith and each of the discharge valves is positioned between the bellows housing and the discharge control valve associated therewith.

19. The method of claim 17, wherein each of the suction control valves is positioned between the bellows housing and the suction valve with which it is associated, wherein each of the discharge control valves is positioned between the bellows housing and the discharge valve with which it is associated, or wherein each of the suction control valves is positioned between the bellows housing and the suction valve with which it is associated and each of the discharge control valves is positioned between the bellows housing and the discharge valve with which it is associated.

20. The method of claim 14, wherein the one or more suction valves comprise at least two electrically actuated suction valves, wherein the one or more discharge valves comprise at least two electrically actuated discharge valves, or wherein the one or more suction valves comprise at least two electrically actuated suction valves and the one or more discharge valves comprise at least two electrically actuated discharge valves.

* * * * *